US012221784B2

(12) United States Patent
Kragness et al.

(10) Patent No.: US 12,221,784 B2
(45) Date of Patent: Feb. 11, 2025

(54) ACOUSTICAL BUILDING PANEL, MONOLITHIC SURFACE COVERING SYSTEM INCORPORATING AN ACOUSTICAL BUILDING PANEL, AND METHODS OF FORMING AND INSTALLING THE SAME

(71) Applicant: ARMSTRONG WORLD INDUSTRIES, INC., Lancaster, PA (US)

(72) Inventors: Eric D Kragness, Sinking Spring, PA (US); Alexandra G Waltemyer, York, PA (US); Jason T Cavanaugh, Lancaster, PA (US); John E Hughes, Lincoln University, PA (US); Lori Jo L Shearer, Millersville, PA (US); Bartolo J Torre, Landisville, PA (US); Allan L. Dinkel, Columbia, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 18/140,430

(22) Filed: Apr. 27, 2023

(65) Prior Publication Data

US 2023/0265652 A1 Aug. 24, 2023

Related U.S. Application Data

(62) Division of application No. 16/702,133, filed on Dec. 3, 2019, now Pat. No. 11,668,091.

(60) Provisional application No. 62/774,523, filed on Dec. 3, 2018.

(51) Int. Cl.
*E04C 2/16* (2006.01)
*E04B 1/99* (2006.01)

(52) U.S. Cl.
CPC . *E04C 2/16* (2013.01); *E04B 1/99* (2013.01)

(58) Field of Classification Search
CPC ..... E04C 2/16; E04B 1/99
See application file for complete search history.

(56) References Cited

U.S. PATENT DOCUMENTS

| | | | |
|---|---|---|---|
| 4,584,224 | A | 4/1986 | Schneller |
| 5,088,260 | A | 2/1992 | Barton |
| 5,198,052 | A | 3/1993 | Ali |
| 5,311,717 | A | 5/1994 | Yount |
| 5,799,458 | A | 9/1998 | Ferguson |

(Continued)

FOREIGN PATENT DOCUMENTS

| | | | |
|---|---|---|---|
| EP | 0943589 | A1 | 9/1999 |
| EP | 0943589 | B1 | 9/2003 |

(Continued)

*Primary Examiner* — Jeremy A Luks
(74) *Attorney, Agent, or Firm* — Patrick Sheldrake

(57) ABSTRACT

An acoustical building panel is disclosed that comprises a fibrous panel comprising: a central portion having a first major surface; a perimeter portion surrounding the central portion; a recess press-formed into the perimeter portion, the recess circumscribing the first major surface and comprising a recess floor surface; a second major surface opposite the first major surface; and side edge surfaces that define a perimeter of the fibrous panel and extend from the second major surface to the recess floor surface.

20 Claims, 28 Drawing Sheets

(56) References Cited

U.S. PATENT DOCUMENTS

| | | | | |
|---|---|---|---|---|
| 6,880,299 | B2 * | 4/2005 | Martin | E04C 2/043 52/745.19 |
| 6,931,814 | B2 | 8/2005 | Henits | |
| 7,591,113 | B2 | 9/2009 | Mourier | |
| 8,210,310 | B1 | 7/2012 | Yeung | |
| 8,763,753 | B2 | 7/2014 | Kray | |
| 8,925,677 | B2 | 1/2015 | Dugan | |
| 9,738,796 | B1 | 8/2017 | Bury | |
| 9,777,478 | B1 | 10/2017 | Hulka | |
| 11,668,091 | B2 * | 6/2023 | Kragness | E04B 1/86 181/175 |
| 2008/0060871 | A1 * | 3/2008 | Englert | C04B 28/14 181/294 |
| 2010/0055439 | A1 * | 3/2010 | Lee | C03C 25/103 428/375 |
| 2013/0209722 | A1 | 8/2013 | Arseneault | |
| 2014/0014437 | A1 | 1/2014 | Wilson | |
| 2017/0121964 | A1 | 5/2017 | Wiker | |
| 2017/0204604 | A1 | 7/2017 | Frank | |
| 2017/0342710 | A1 | 11/2017 | Gaydos | |
| 2018/0238504 | A1 | 8/2018 | Oleske | |

FOREIGN PATENT DOCUMENTS

| | | | |
|---|---|---|---|
| EP | 2971391 | B1 | 6/2018 |
| JP | 2007/002580 | A | 1/2007 |
| WO | WO 2000/053860 | A1 | 9/2000 |
| WO | WO 2013/067614 | A1 | 5/2013 |

* cited by examiner

ACOUSTICAL BUILDING PANEL, MONOLITHIC SURFACE COVERING SYSTEM INCORPORATING AN ACOUSTICAL BUILDING PANEL, AND METHODS OF FORMING AND INSTALLING THE SAME

CROSS-REFERENCE TO RELATED APPLICATIONS

This application is a continuation application of U.S. patent application Ser. No. 16/702,133, filed on Dec. 3, 2019, which claims the benefit of U.S. Provisional Application No. 62/774,523, filed on Dec. 3, 2018. The disclosure of the above application is incorporated herein by reference.

BACKGROUND

Surface covering systems are installed in room environments to cover undesirable and/or rough surfaces. Such surface coverings can take the form of wall systems and ceiling systems. In addition to increasing the aesthetic appeal of room environments, it is often desirable that these surface covering systems be "acoustical" in nature such that they help eliminate and/or reduce noise.

Surface covering systems, such as drywall (or gypsum board), have become popular due to their monolithic and uninterrupted appearance. However, drywall-based surface covering systems are notoriously poor at controlling noise within a room environment. While surface covering systems that utilize acoustical panels (panels specifically designed to mitigate and control noise levels) have been used, these types of surface covering systems are often deemed aesthetically undesirable because of the visibility of seams and/or grid.

Thus, a need exists for a surface covering system that achieves the monolithic appearance of drywall-based surface covering systems while at the same time achieving acceptable levels of acoustic performance (i.e., noise reduction).

SUMMARY OF THE INVENTION

In one aspect, the invention can be an acoustical building panel comprising: a fibrous panel comprising: a central portion having a first major surface; a perimeter portion surrounding the central portion; a recess press-formed into the perimeter portion, the recess circumscribing the first major surface and comprising a recess floor surface; a second major surface opposite the first major surface; and side edge surfaces that define a perimeter of the fibrous panel and extend from the second major surface to the recess floor surface.

In another aspect, the invention can be a surface covering system that comprises: a support structure; a plurality of the acoustical building panels described in the preceding paragraph mounted to the support structure so that side edge surfaces of adjacent ones of the plurality of acoustical building panels define a seam therebetween and the recesses of the adjacent ones of the plurality of acoustical building panels collectively define seam channels; a seam concealment sub-system filling the seam channels and having an exposed surface that is substantially flush with the first major surfaces of the plurality of acoustical building panels; and a coating applied to the front surfaces of the plurality of acoustical building panels and the exposed surface of the seam concealment sub-system to give the surface covering system a monolithic appearance.

In a further aspect, the invention can be a method of forming an acoustical panel comprising: a) providing a flat fibrous panel having a first planar surface, a second planar surface opposite to and extending parallel to the first planar surface, side edge surfaces extending between the first and second planar surfaces; and b) press-forming a permanent recess into the top surface of the flat fibrous panel adjacent the side edge surfaces, the permanent recess circumscribing a central portion of the fibrous panel, thereby forming a profiled fibrous panel.

In an even further aspect, the invention can be a method of installing a surface covering system comprising: a) mounting a plurality of acoustical building panels to a support structure so that side edge surfaces of adjacent ones of the plurality of acoustical building panels define a seam therebetween and recesses press-formed into fibrous panels of the adjacent ones of the plurality of acoustical building panels collectively define a seam channel, wherein, for each of the plurality of acoustical building panels, the fibrous panel has a central portion having a first major surface that is circumscribed by the recess; b) filling the seam channels with a seam concealment sub-system having an exposed surface that is substantially flush with the first major surfaces of the plurality of acoustical building panels; and c) applying a coating to the first major surfaces of the plurality of acoustical building panels and the exposed surface of the seam concealment sub-system to give the surface covering system a monolithic appearance.

In some embodiments, the present invention includes an acoustical building panel comprising: a fibrous panel comprising: a central portion having a first major surface; a perimeter portion circumscribing the central portion, the perimeter portion having a recess comprising a recess floor surface; a second major surface opposite the first major surface; and side edge surfaces that define a perimeter of the fibrous panel and extend from the second major surface to the recess floor surface; wherein the perimeter portion comprises the side edge surfaces, the perimeter portion having a first average density and the central portion having a second average density that is less than the first average density.

In some embodiments, the present invention includes an acoustical building panel comprising: a body; and a scrim attached to the body; the acoustical building panel further comprising: a central portion having a first major surface; a perimeter portion circumscribing the central portion; a recess having a recess floor surface, the recess press-formed into at least a portion of the scrim present in the perimeter portion; a second major surface opposite the first major surface; and side edge surfaces that define a perimeter of the acoustical building panel and extend from the second major surface to the recess floor surface.

Other embodiments of the present invention include a surface covering system comprising: a support structure; a plurality of acoustical building panels mounted to the support structure so that side edge surfaces of adjacent ones of the plurality of acoustical building panels define a seam therebetween and the recesses of the adjacent ones of the plurality of acoustical building panels collectively define seam channels; a seam concealment sub-system filling the seam channels and having an exposed surface that is substantially flush with the first major surfaces of the plurality of acoustical building panels; and a coating applied to the front surfaces of the plurality of acoustical building panels and the exposed surface of the seam concealment subsystem to give the surface covering system a monolithic appearance.

Other embodiments of the present invention include a method of forming an acoustical panel comprising: a) providing a panel having a top surface opposite a bottom surface and a side edge surfaces extending between the top surface and bottom surfaces, the panel comprising a scrim coupled to a body, the top surface of the panel formed by the scrim; and b) press-forming a permanent recess into the top surface of the panel adjacent the side edge surfaces, the permanent recess formed into the scrim and the body, thereby forming a profiled fibrous panel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
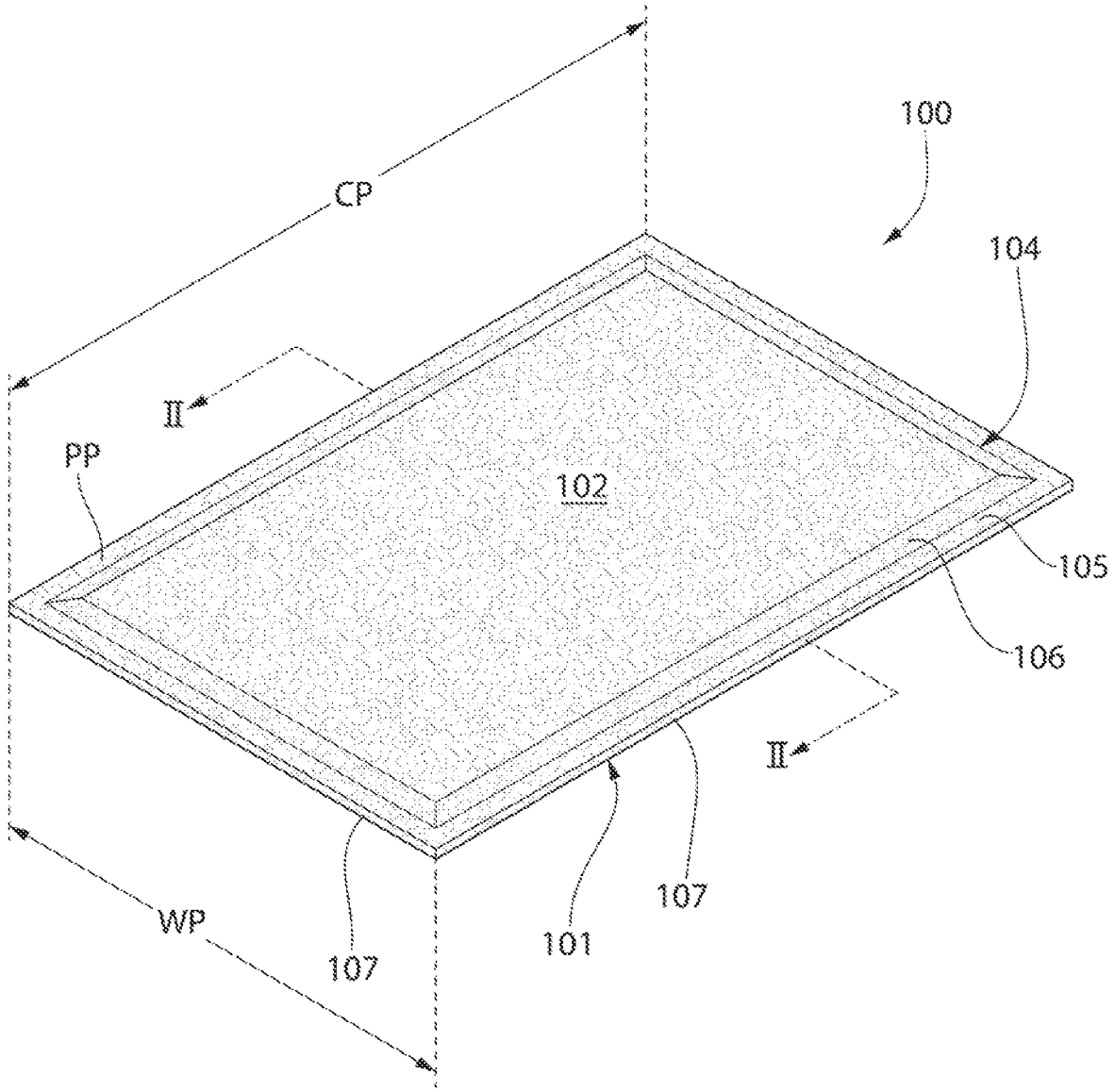
FIG. 1 is front perspective view of an acoustical building panel according to an embodiment of the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

Figure 2:
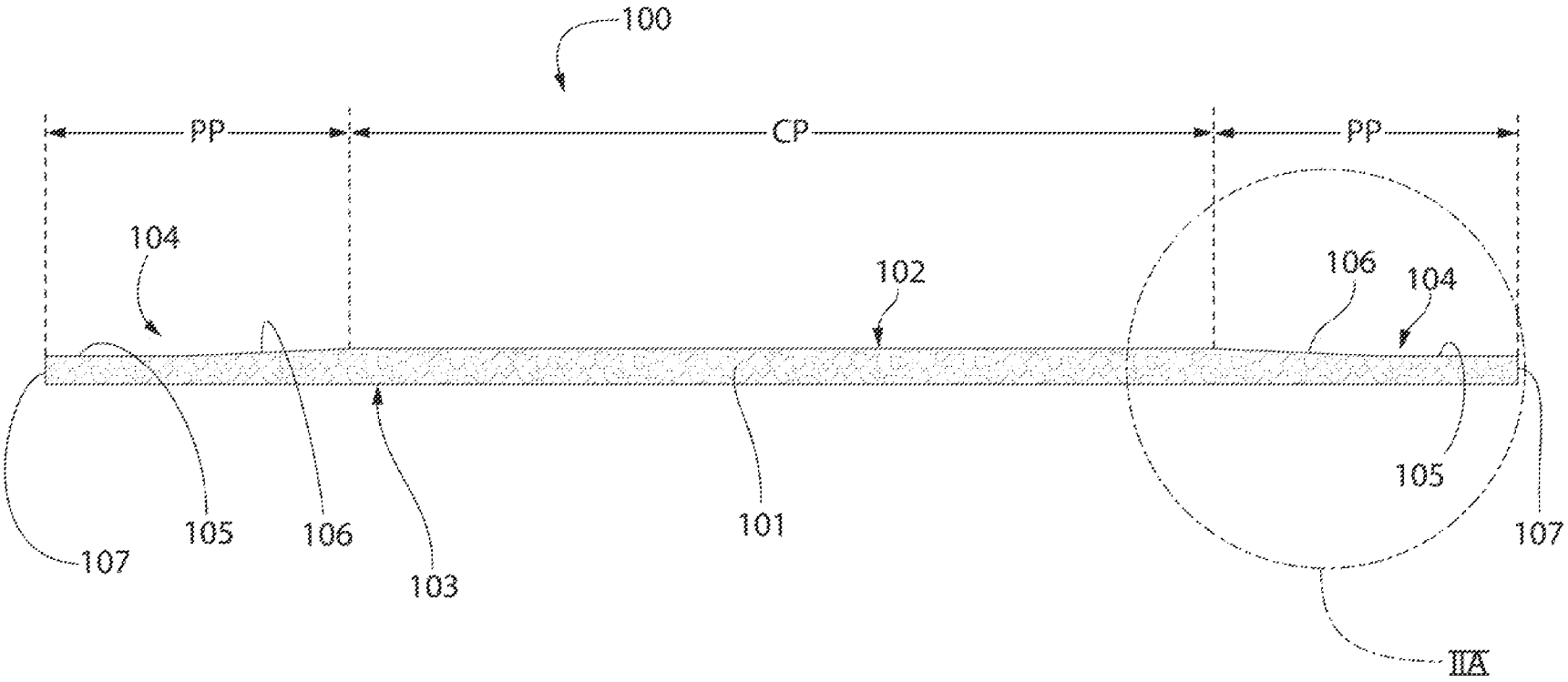
FIG. 2 is a cross-sectional view of the acoustical building panel of FIG. 1 taken along view II-II of FIG. 1.
Figure 2A:
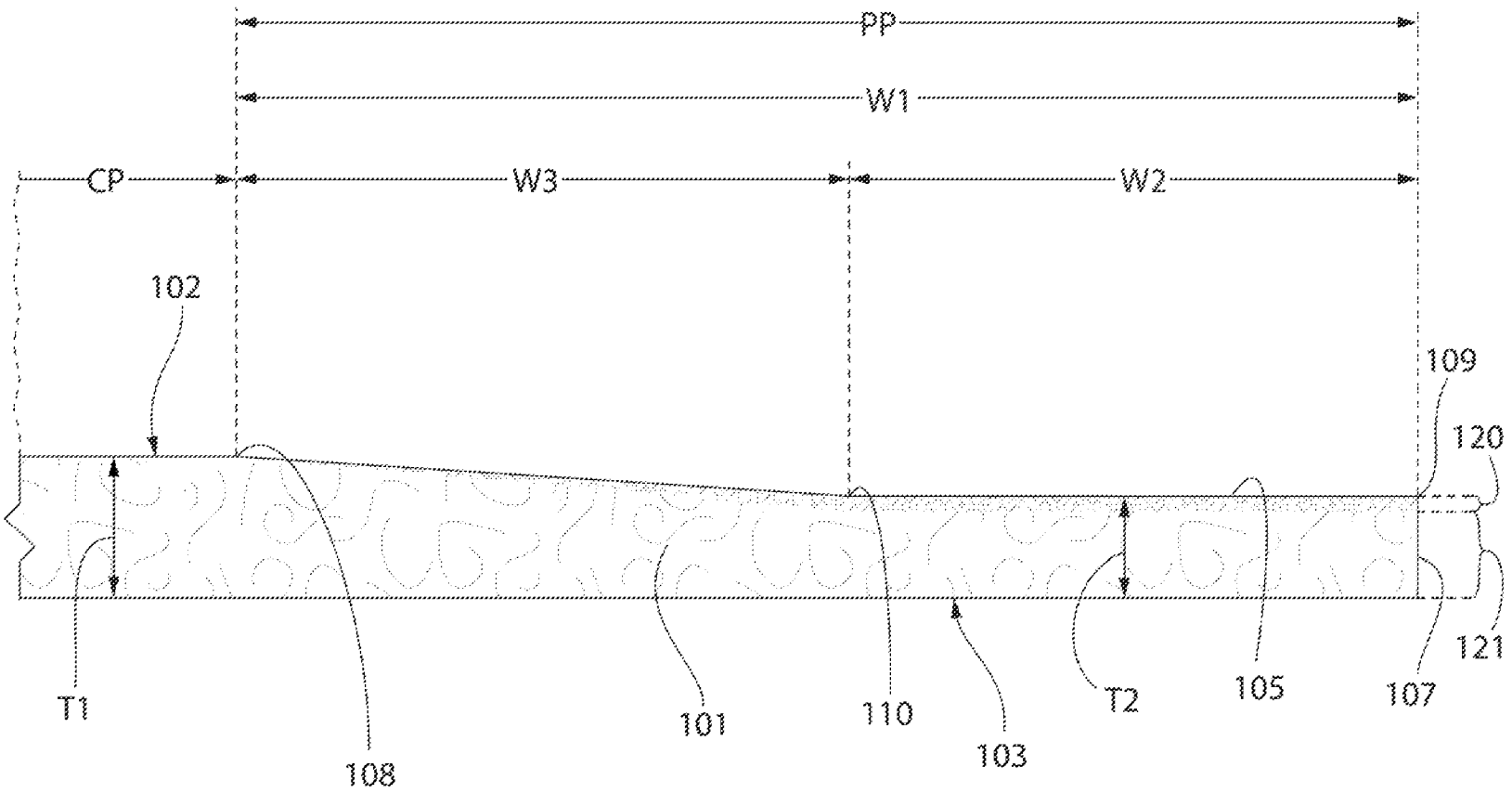
FIG. 2A is a close-up of area IIA of FIG. 2.

Referring first to FIGS. 1, 2, and 2A concurrently, an acoustical building panel 100 according to an embodiment of the present invention is disclosed. The acoustical building panel 100 generally comprises a fibrous panel 101. In the exemplified embodiment of FIGS. 1, 2, and 2A, the fibrous panel 101 is a singular monolithic fibrous board that is compressed so as to have a profiled perimeter portion, as will be described in greater detail below. However, in other embodiments, the acoustical building panel 100 can be a multi-layer structure that comprises multiple fibrous layers, such as a fibrous board having a fibrous scrim attached thereto. Such an embodiment is discussed below with respect to FIGS. 24 and 24A.

The acoustical building panel 100 (and the fibrous panel 101) is rectangular and elongated having a panel width WP and a panel length LP, wherein the panel length LP is greater than the panel width WP. In one embodiment, the panel length LP is at least 1.5 times greater than the panel width WP. In one embodiment, the panel width WP is in a range of 2 ft. to 6 ft. and the panel length LP is in a range of 4 ft. to 8 ft. While the exemplified embodiment of the acoustical building panel 100 is rectangular in shape, in other embodiments the acoustical building panel 100 can take on any polygonal shape, such as triangular, square, pentagonal, hexagonal, octagonal, etc.

The fibrous panel 101 generally comprises a central portion CP and a perimeter portion PP surrounding the central portion CP. The central portion CP has a first major surface 102 that is opposite a second major surface 103 of the fibrous panel 101. The second major surface 103 forms a lower surface of both of the central portion CP and the perimeter portion PP. Each of the first and second major surfaces 102, 103 are substantially planar and parallel to one another. Of course, due to their being fibrous in nature, each of the first and second major surfaces 102, 103 are textured.

A recess 104 is press-formed into the perimeter portion PP (the process and resulting structural results of which will be discussed in greater detail below). The recess 104 circumscribes the first major surface 104. The recess 104 is permanent in nature and, thus may be referred to herein as a permanent recess in certain instances. The recess 104 comprises a recess floor surface 105 and a recess wall surface 106. In the exemplified embodiment, the recess floor surface 105 is a substantially planar surface that is parallel to each of the first major surface 102 and the second major surface 103. In other embodiments, the recess floor surface 105 may be curved, contoured, stepped, irregular, or otherwise non-planar in nature. In still other embodiments, the recess floor surface 105 may be inclined, or otherwise, non-parallel to one or both of the first and second major surfaces 102, 103.

The recess floor surface 105 extends inward from side edges surfaces 107 of the fibrous panel 101. The side edges surfaces 107 define a perimeter of the fibrous panel 101 and extend from the second major surface 103 to the recess floor surface 105. As exemplified, the side edge surfaces 107 are continuous surfaces that are free of any cutouts or channels.

The recess wall surface 106 is an inclined surface that extends inward and upward from the recess floor surface 105 to the first major surface 102. As exemplified, the recess wall surface 106 is a substantially planar surface. In another embodiment, the recess wall surface 106 is a curved or contoured surface, such as a concave surface or a convex surface. In still certain other embodiments, the recess 104 may be formed such that there is no clear distinction between the recess floor surface 105 the recess wall surface 106 but rather one may transition into the other. In an even further embodiment, the recess floor surface 105 may be an inclined substantially planar surface that extends from the side edge surface 107 to the first major surface 102. Stated simply, the recess 104 may take on a wide variety of transverse profiles.

The recess 104 has a first transverse width W1 measured from an outer edge 108 of the first major surface 102 to a recess edge 109. The outer edge 108 is formed by an intersection of the recess wall surface 106 and the first major surface 102. The recess edge 109 is formed by an intersection of the recess floor surface 105 and the side edge surface 107. The recess floor surface 105 has a second transverse width W2 measured from the recess edge 109 to a recess corner 110. The recess corner 110 is formed by an intersection between the recess floor surface 105 and the recess wall surface 106. The recess wall surface 106 has a third transverse width W3 measured from the recess corner 110 to the outer edge 108 of the first major surface 102.

In one embodiment, the second and third transverse widths W2, W3 are substantially equal to one another. In another embodiment, the second transverse width W2 is greater than or equal to about one-half of the third width W3.

The fibrous panel 101 has a first thickness T1 at the central portion CP, measured from the first major surface 102 to the second major surface 103. The fibrous panel 101 has a second thickness T2 at the perimeter portion PP, measured from the recess floor surface 105 to the second major surface 103. The second thickness T2 is less than the first thickness T1. In one embodiment, a ratio of the first thickness T1 to the second thickness T2 is at least 1.05:1, and more preferably at least 1.08:1, and most preferably in a range of 1.05:1 to 1.15:1. In another embodiment, a ratio of the first thickness T1 to the difference between the first thickness T1 and the second thickness T2 is in a range 8:1 to 16:1, and more preferably in a range of 10:1 to 14:1. In still another embodiment, the first thickness T1 is in a range of 0.5 inch to 1.0 inch, while a difference between the first thickness T1 the second thickness T2 is in a range of 0.05 inch to 0.1 inch.

The acoustical building panel 100 is specifically designed to mitigate or otherwise control noise within a room environment. To this end, in one embodiment, the acoustical building panel 100 has a noise reduction coefficient ("NRC") of at least 0.4, more preferably at least 0.5, and most preferably at least 0.65. In one embodiment, the acoustical building panel 100 has a NRC in a range of 0.65 to 1.0. The acoustical building panel 100 may also (or instead of) have a ceiling attenuation class ("CAC") of at least 30, more preferably at least 35, and most preferably in a range of 45 to 55.

The fibrous panel 101 comprises a mineral fiber board, which may be formed of organic or inorganic fibers (and may include binders and other additives). Suitable fibrous materials include mineral wool, fiberglass, polyester, cotton, jute, cellulosic fibers, abaca, and combinations thereof. As mentioned above, the recess 104 is press-formed into the fibrous panel 101. As a result of the fibrous nature of the panel 101, the press-forming of the recess 104 into the perimeter portion PP results in at least a portion (in the form of upper layer 120) of the perimeter portion PP of the fibrous panel 101 is in a permanently-compressed state, resulting in a greater fiber density. This, permanently-compressed portion is shown as upper layer 120 in FIG. 2A having a denser illustration of fibers. As can also be seen, while the upper layer portion 120 of the perimeter portion PP of the fibrous panel 101 is in the permanently-compressed state, a lower layer portion 121 of the fibrous panel 101 remains in a non-compressed state. Similarly, in certain embodiments, the entirety of the central portion CP does not undergo substantial compression during the press forming of the recess 104 and, thus, remains in a non-compressed state.

As a result of the above, the perimeter portion PP will have a first average density while the central portion CP will have a second average density that is less than the first average density. Additionally, as a result of the fibers becoming compressed in the perimeter portion PP (and not in the central portion CP), the central portion CP of the fibrous panel 101 will have a first airflow resistance measured from the first major surface 102 to the second major surface 103 and the perimeter portion PP of the fibrous panel 101 will have a second air flow resistance measured from the recess floor surface 105 to the second major surface 103. The second airflow resistance is greater than the first airflow resistance. In one embodiment, the first airflow resistance is no greater than 8000 MKS Rayls, more preferably no greater than 6000 MKS Rayls, and most preferably in the range of 400 to 5000 MKS Rayls.

Figure 24:
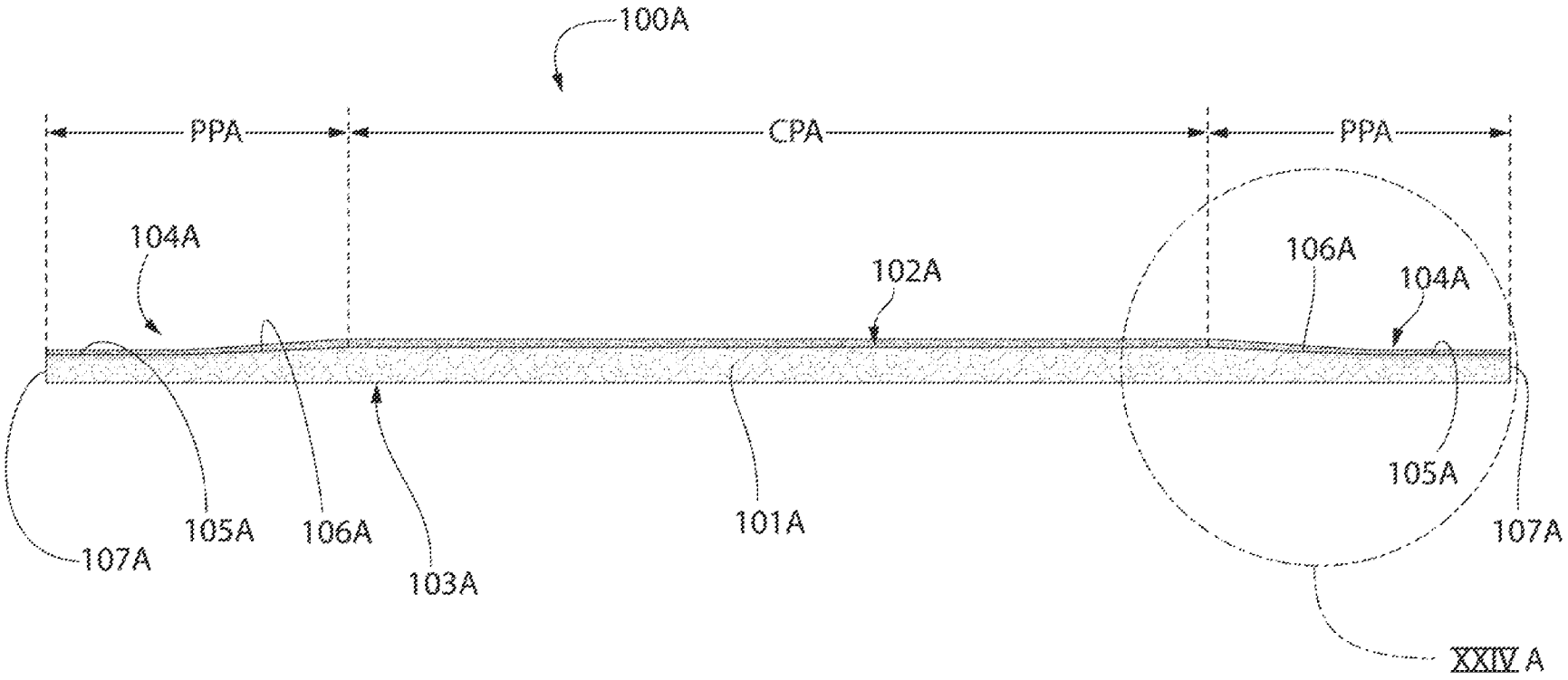
FIG. 24 is a cross-sectional view of an acoustical building panel according to another embodiment of the present invention, wherein the fibrous panel comprises a fibrous body/board and a scrim attached thereto.
Figure 24A:
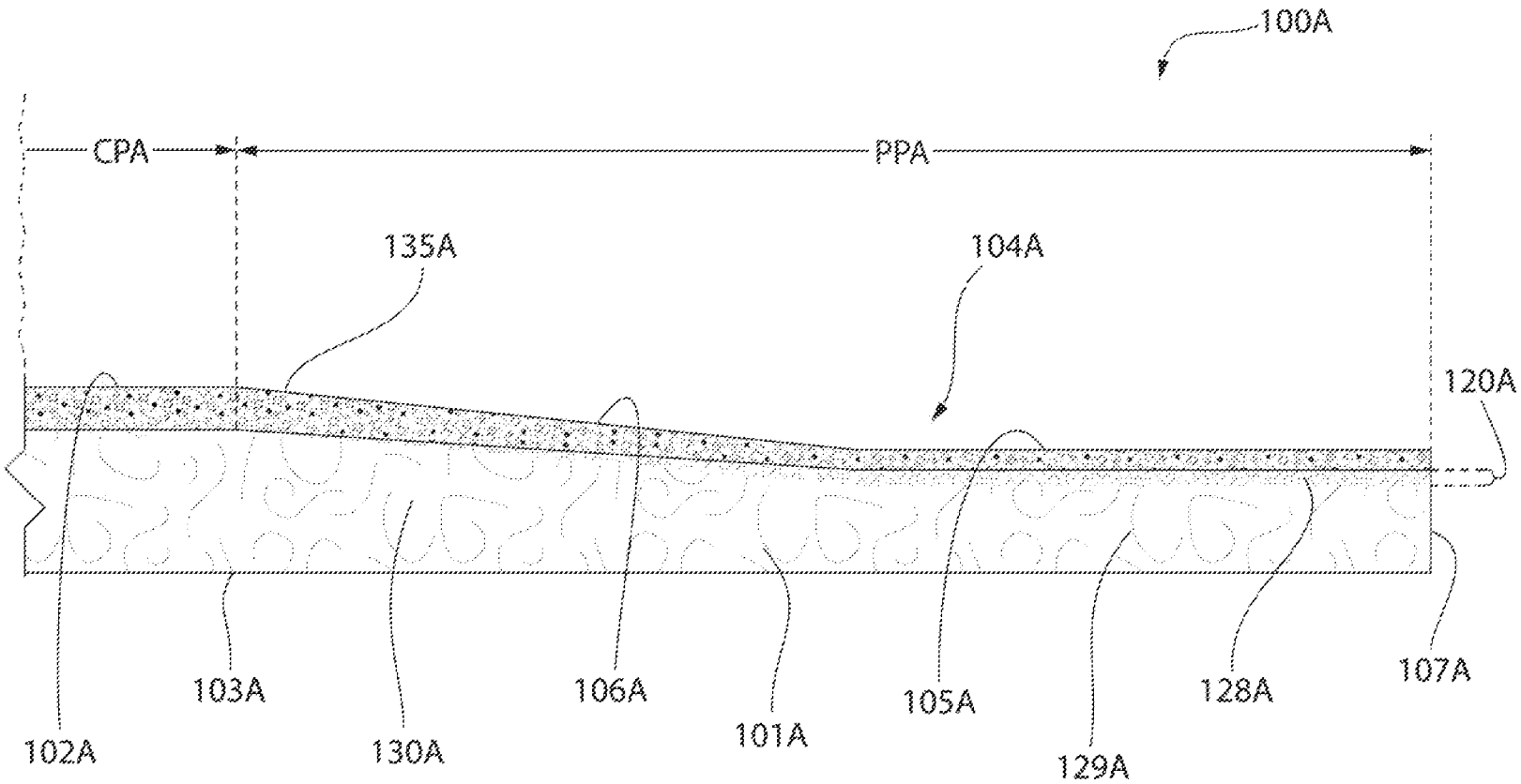
FIG. 24A is a close-up of area IIA of FIG. 24.

Referring now to FIGS. 24-25 concurrently, a second embodiment of an acoustical building panel 100A is shown. The acoustical building panel 100A is identical in structure and properties as the acoustical building panel 100 discussed above with respect to FIGS. 1-2A with the exception that the fibrous panel 101A is a multilayer fibrous structure rather than a singular monolithic fibrous body. Thus, only those aspects of the acoustical building panel 100A that differ from the acoustical building panel 100 will be discussed below with the understanding that the discussion above relating to the remainder of the structural details and properties of the acoustical building panel 100 is applicable. Thus, like reference numerals will be used for like elements in the FIGS. with the exception that the alphabetical suffix "A' will be added to the numerical identifier.

The fibrous panel 101A of the acoustical building panel 100A comprises a body 130A and a scrim 135A coupled to the body 130A. The body 130A may be an acoustical body. The term "acoustical body" refers to a body that is capable of allowing air to flow through the body between major surfaces, thereby creating desired acoustical characteristics for NRC and/or CAC performance within a ceiling system.

The body 130A may be a fibrous body 130A, such as a fibrous board, which may be formed of organic or inorganic fibers (and may include binders and other additives). Suitable fibrous materials include mineral wool, fiberglass, polyester, cotton, jute, cellulosic fibers, abaca, and combinations thereof. One suitable example of the fibrous body 130A is an Ultima 80 GIP, distributed by Armstrong World Industries. The scrim 135A, in one embodiment, is a fiberglass scrim, such as a CD-20 fiberglass scrim.

The fibrous panel 101A comprises a recess 104A that circumscribes a central portion CPA. The fibrous body 130A comprises the second major surface 103A. The scrim 135A comprises the first major surface 102A, the recess floor surface 105A, and the recess wall surface 106A. The side edge surfaces 107A of the fibrous panel 101A are formed by a portion of each of the scrim 135A and the fibrous body 130A.

The recess 104A is press-formed into the fibrous panel 101A. As a result, a portion of the perimeter portion PPA of the fibrous panel 101A is in a compressed-state, thereby resulting in the existence of the recess 104A. In other words, this portion of the perimeter portion PPA of the fibrous panel 101A will have a greater fiber density than the remaining uncompressed portions of the fibrous panel 101. In this embodiment, the permanently-compressed portion comprises an upper layer 120A in FIG. 2A that includes the scrim 135A and an upper layer portion 128A of the fibrous body 130A. While the upper layer portion 128A of the perimeter portion PPA of the fibrous body 130A is in the permanently-compressed state, a lower layer portion 129A of the fibrous panel 101 remains in a non-compressed state. Similarly, the entirety of the central portion CPA does not undergo substantial compression during the press forming of the recess 104A and, thus, remains in a non-compressed state.

As a result of the above, the perimeter portion PPA will have a first average density while the central portion CPA will have a second average density that is less than the first average density. Additionally, as a result of the fibers becoming compressed in the perimeter portion PPA (and not in the central portion CPA), the central portion CPA of the fibrous panel 101A will have a first airflow resistance measured from the first major surface 102A to the second major surface 103A and the perimeter portion PPA of the fibrous panel 101A will have a second air flow resistance measured from the recess floor surface 105A to the second major surface 103A. The second airflow resistance is greater than the first airflow resistance. In one embodiment, the first airflow resistance is no greater than 8000 MKS Rayls, more preferably no greater than 6000 MKS Rayls, and most preferably in the range of 800 to 5400 MKS Rayls.

The acoustical building panel 100A is specifically designed to mitigate or otherwise control noise within a room environment. To this end, in one embodiment, the acoustical building panel 100A has a noise reduction coefficient ("NRC") of at least 0.4, more preferably at least 0.5, and most preferably at least 0.65. In one embodiment, the acoustical building panel 100 has a NRC in a range of 0.65 to 1.0. The acoustical building panel 100 may also (or instead of) have a ceiling attenuation class ("CAC") of at least 30, more preferably at least 35, and most preferably in a range of 45 to 55.

Referring now to FIGS. 3-6C, a process of forming the acoustical panel 100 according to an embodiment of the present will be described. It is to be understood that while the formation process will be illustrated with respect to the acoustical panel 100, the same process can be used to form the acoustical panel 100A.

Figure 3:
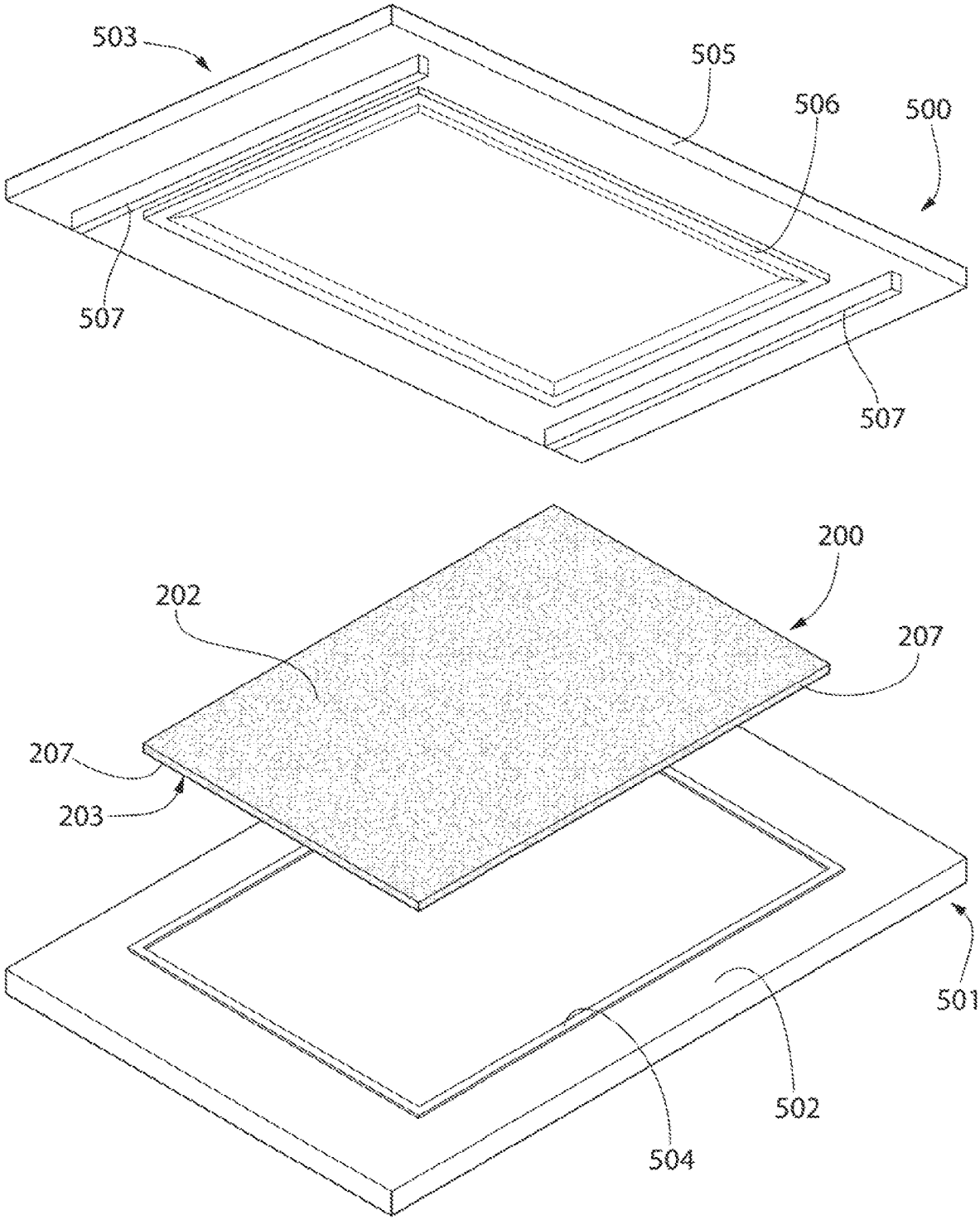
FIG. 3 is a perspective view of a flat fibrous panel being loaded into an open press during the formation of an acoustical building panel according to an embodiment of the present invention.

Referring initially to FIG. 3, a flat fibrous panel 200 is provided. In one embodiment, the flat fibrous panel 200 is cut from a fibrous master panel (not shown). The fibrous master panel is formed from a fiber slurry that is dried, as is know in the art. The fibrous master panel may be a mineral fiber board. In embodiments where the flat fibrous panel 200 is to include a scrim, a scrim is coupled to the dried mineral fiber board that is formed from the slurry, thereby forming the fibrous master panel. The master fibrous panel 200 has a length and a width that is greater than the length and width of any individual one of the plurality of the flat fibrous panels 200 that will be cut from it. In some embodiments, the master fibrous panel 200 is a larger format panel having a length and width of 12 ft. or greater, while the flat fibrous panels 200 have a length of about 6 ft. and a width of about 4 ft. Once formed (and fully dried in certain embodiments), the fibrous master panel is cut into a plurality of flat fibrous panels 200. At this stage, each of the flat fibrous panels 200 is cut form the fibrous master panel so as to have their final (or near final) width and length dimensions (i.e., they are cut to have the desired panel width WP and panel length LP of the final acoustical panel 100 (as discussed above).

The flat fibrous panel 200, which is in a fully dried state, has a first planar surface 202, a second planar surface 203, and side edge surfaces 207 extending between the first and second planar surfaces 202, 203. The second planar surface 203 is opposite to and extends parallel to the first planar surface 202. As exemplified, the flat fibrous panel 200 is rectangular in shape but can take on any desired polygonal shape.

A press 500 is provided. The press 500 comprises a fixed support 501, in the form of a lower platen 502, and a movable die 503. The lower platen 501 comprises an indexing element 504, which is in the form of rectangular ridge, which is used to properly position and orient the flat fibrous panel 200 within the press (and maintain the flat fibrous panel 200 in said proper position and orientation during the pressing process). While the indexing element 503 is exemplified a closed-geometry rectangular ridge, in other embodiments, the indexing element 503 may take the form of one or more separate ridge segments that are located to contact at least two non-parallel side edge surfaces 207 of the flat fibrous panel 200. In still other embodiments, the indexing element 503 may in the form of pins, which may or may not be retractable. In further embodiments, the indexing element 503 could be a depression formed in the lower platen 501.

The movable die 502 comprises an upper platen 505, a profiling tool 506, and a depth control element 507. The profiling tool 506 is configured to form the desired transverse profile of the recess that is to be formed in the flat fibrous panel 200 (discussed in greater detail below). The depth control element 507, which is in the form of stop bars, are sized and configured to limit the extent to which the movable die 503 can be brought toward the base support 501. It should be noted that while the press is exemplified as the profiling tool 506 being moved relative to the flat fibrous panel 200 during the recess formation process, it is also possible to design the press 300 so that the flat fibrous panel 200 is moved and pressed into contact with a stationary profiling tool 506.

Figure 4:
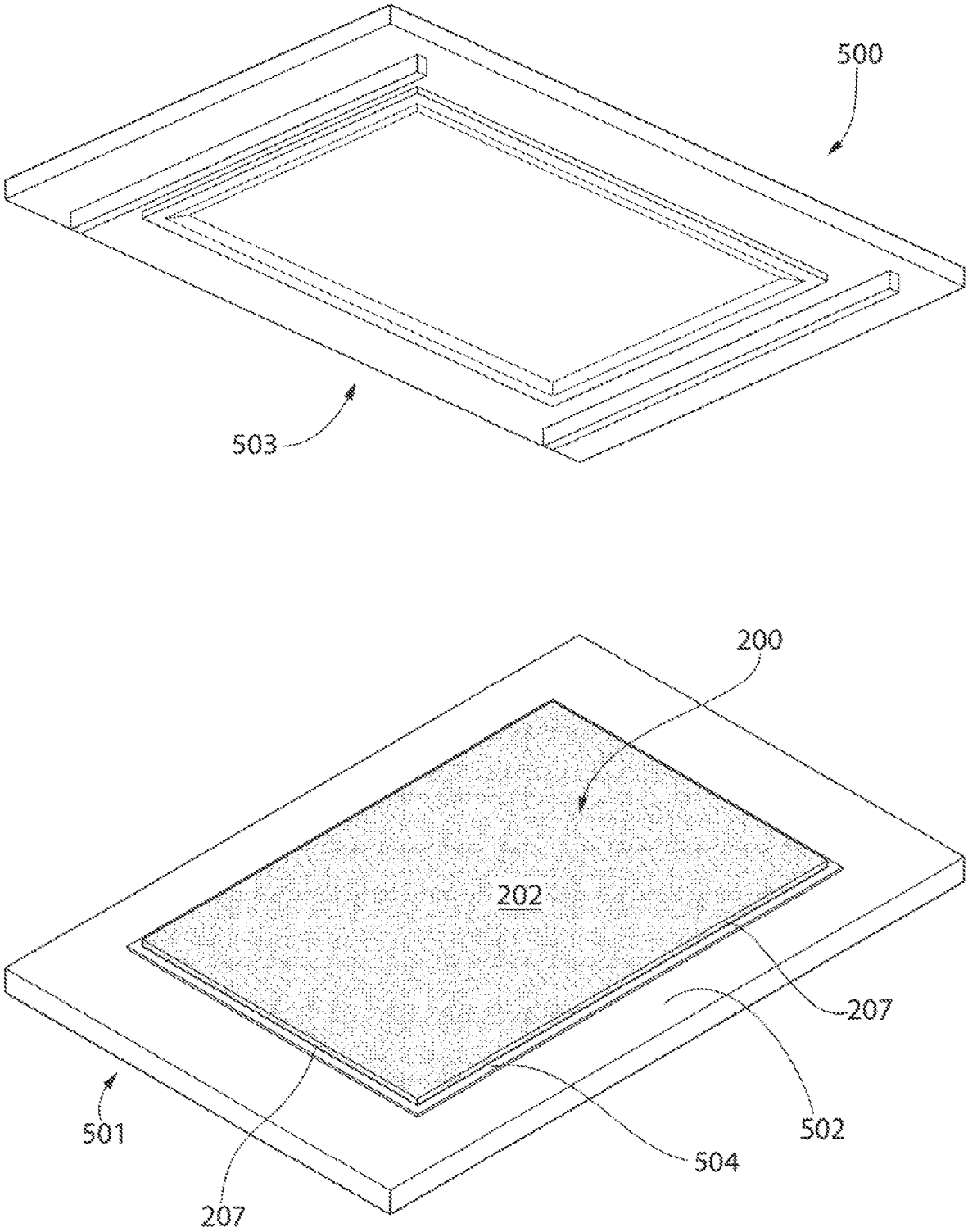
FIG. 4 is a perspective view of the flat fibrous panel being loaded into and positionally indexed within the open press of FIG. 4.
Figure 5:
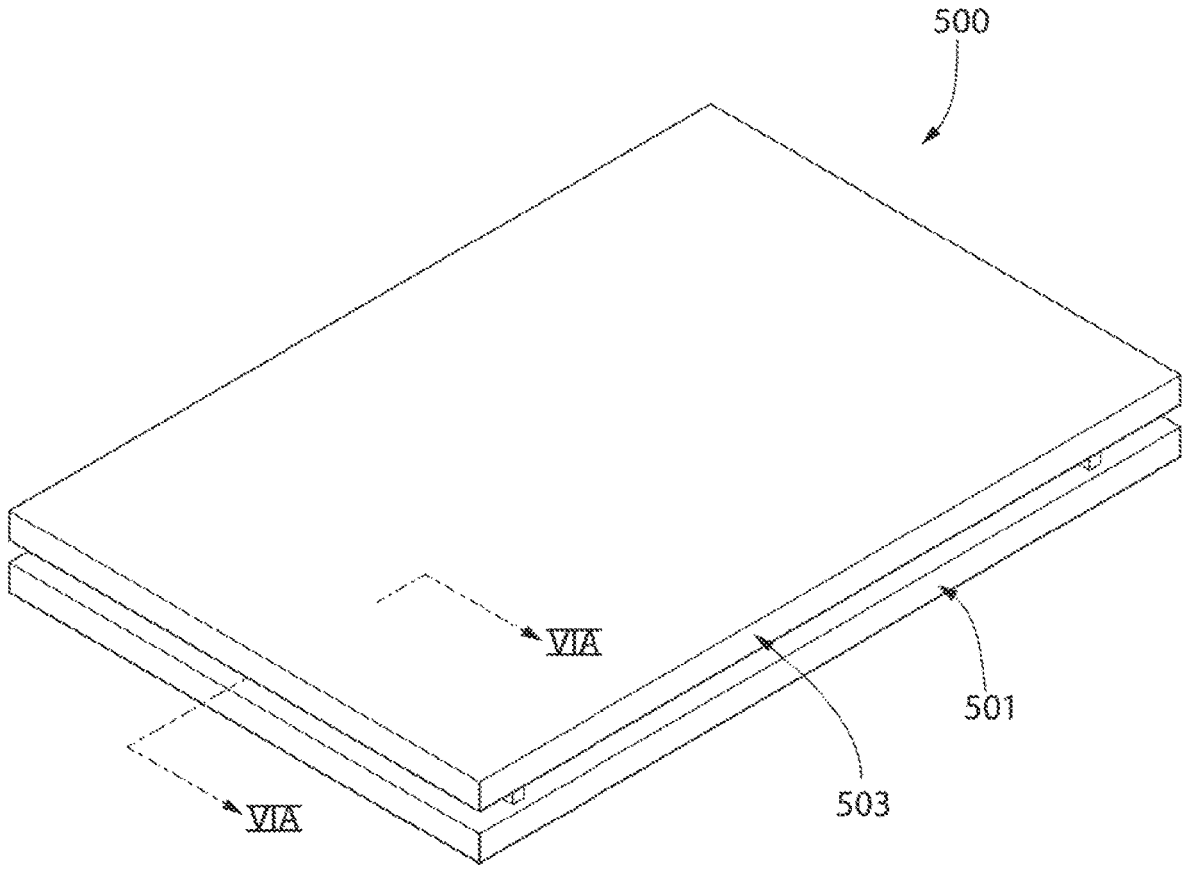
FIG. 5 is a perspective view of the press of FIG. 4 in a partially-closed state.

Referring now to FIG. 4, the flat fibrous panel 200 is positioned in the press 500. The flat fibrous panel 200 is inserted into the press 500 and properly positioned and oriented therein by abutting the side edge surfaces 207 of the flat fibrous panel 200 against the indexing element 504 as shown. As a result, the flat fibrous panel 200 engages the indexing element 504. The press 500 is then closed by lowering the die 503, as is shown in FIGS. 5, 6A.

Figure 6A:
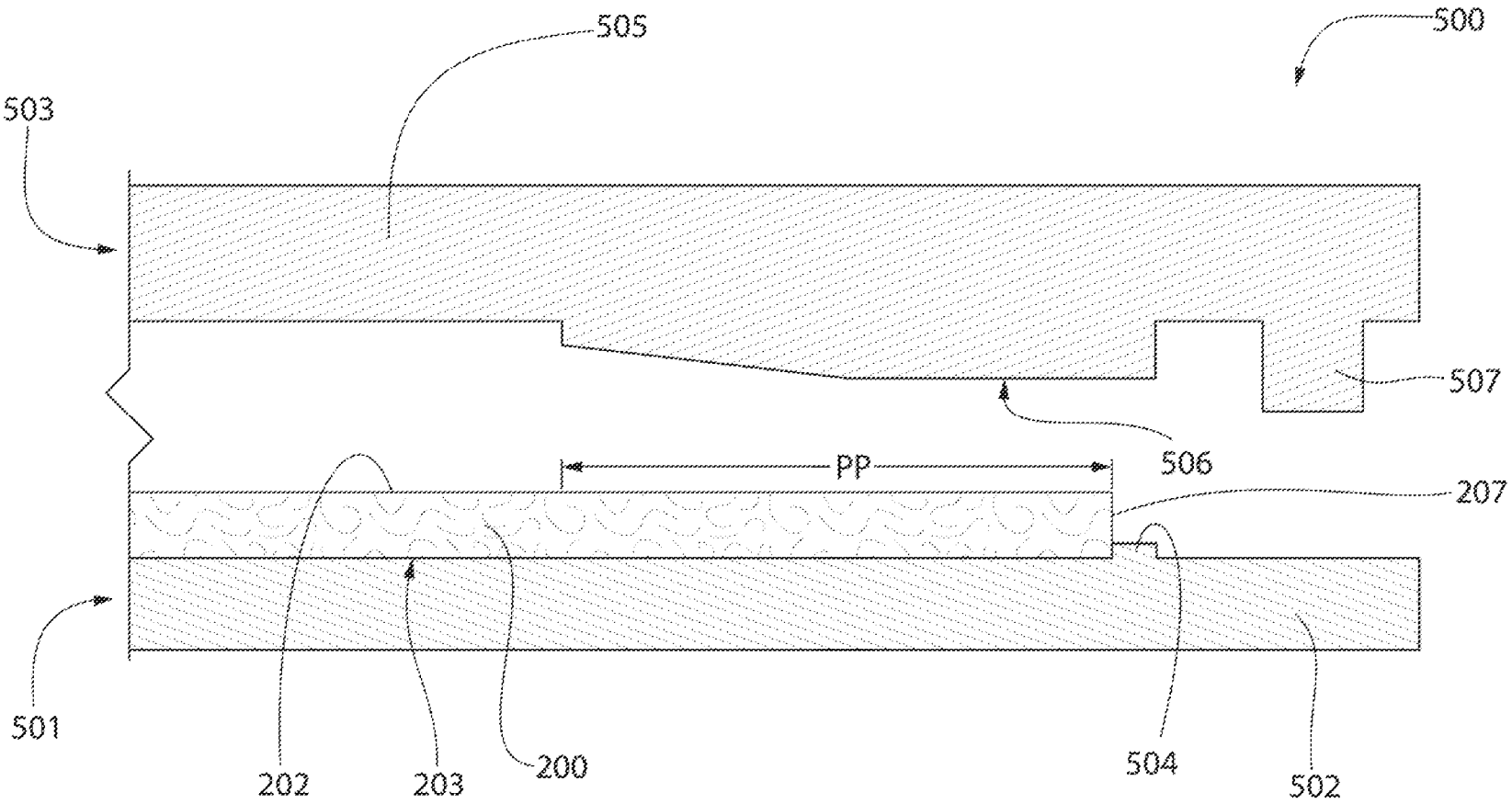
FIG. 6A is a cross-section of the partially-closed press of FIG. 5 taken along view VIA-VIA of FIG. 5, wherein the flat fibrous panel is yet to be compressed.

Referring now to FIGS. 6A, it can be seen that the profiling tool 506 is located inboard of the depth control element 507. The profiling tool 506 opposes the first planar surface 202 and is aligned with a perimeter portion PP of the flat fibrous panel 200. The profiling tool 506 (which is shown in transverse section in FIG. 6A) has a transverse profile that corresponds to the desired transverse profile of the permanent recess that is to be formed in the acoustical building panel.

The profiling tool 506, as exemplified, is designed to compress (and thus form the recess) into all four sides of the flat fibrous panel 200 simultaneously. Thus, the profiling tool 506, as illustrated, is in the form of a rib having a closed-geometry polygonal shape that corresponds to the polygonal shape of the flat fibrous panel 200 that is to be profiled. In other embodiments, the profiling tool 506 can, however, be design to profile only one side of the flat fibrous panel 200 at a time, wherein the flat fibrous panel 200 will be rotated accordingly in between multiple pressing operations. Preferably, however, the profiling tool 506 will be configured to simultaneously press-form portions of the permanent recess into the top surface 202 of the flat fibrous panel 200 along non-parallel ones of the plurality of linear side edge surfaces. In one such other embodiment, the profiling tool 506 may take on an L-shape (which can profile two adjacent sides of the flat fibrous panel 200 simultaneously) or a U-shape (which can profile one full side and portions of the two sides adjacent the full side of the flat fibrous panel 200 simultaneously).

The profiling tool 506 can be formed of a variety of materials that are harder than the material of the flat fibrous panel 200, including wood or metal. Additionally, while the profiling tool 506 is shown as being integrally formed with the upper platen 505, in other embodiments, the profiling tool 506 is a separate component that can be removed and replaced as needed. In still other embodiments, the upper platen 505 may be omitted.

Figure 6B:
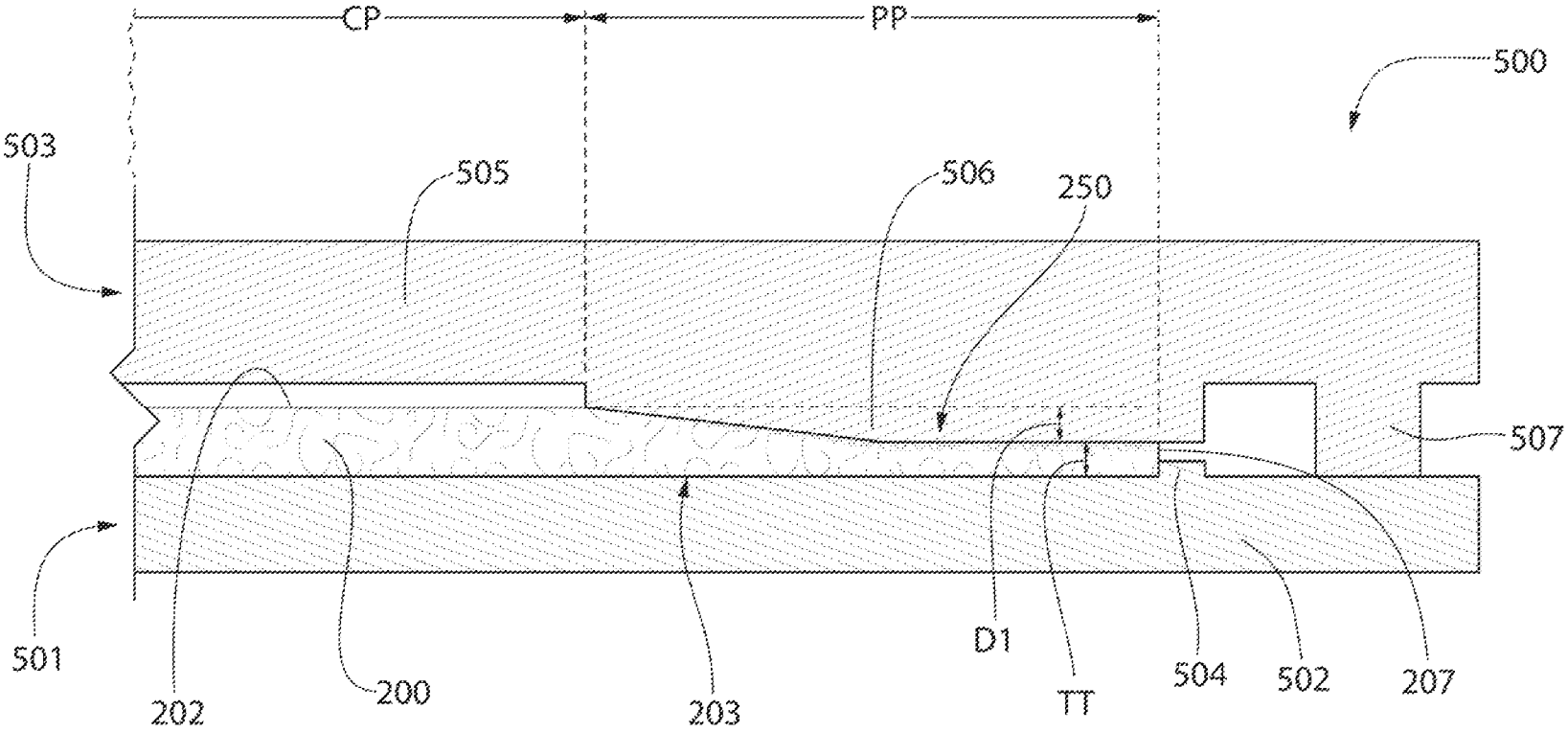
FIG. 6B is a cross-section of the press of FIG. 6A in a fully closed state, wherein a perimeter portion of the flat fibrous panel is compressed by a profiling tool of the press into a first compressed state.

Referring now to FIG. 6B, after the profiling tool 506 contacts the upper planar surface 202 along the perimeter portion PP of the flat fibrous panel 200, the die 503 continues to be translated (which is exemplified as a lowering movement) with sufficient force and pressure so that the profiling tool 506 is driven into the upper planar surface 202 until the depth control element 507 of the press 500 contacts the lower platen 502 and prevents further compression of the perimeter portion PP of the flat fibrous panel 200. As a result of the profiling tool 506 being pressed into the first planar surface 202 of the flat fibrous panel 200, the perimeter portion PP of the flat fibrous panel 200 is compressed due to its fibrous nature.

As can be seen, the profiling tool 506 is driven into the first planar surface 202 of the flat fibrous panel 200 a first depth to compress the perimeter portion PP of the flat fibrous panel 200 a first compressed amount (shown in FIG. 6B), thereby forming a transitory recess 250 in the flat fibrous panel 200 that has a first maximum depth D1. At this stage, the flat fibrous panel 200 has a transitory thickness TT measured from the transitory recess floor surface 251 to the second planar surface 203. The profiling tool 506 maintains this position for a predetermined period of time to ensure adequate permanent compression/compaction of the fibers in the perimeter portion PP of the flat fibrous panel 200.

Figure 6C:
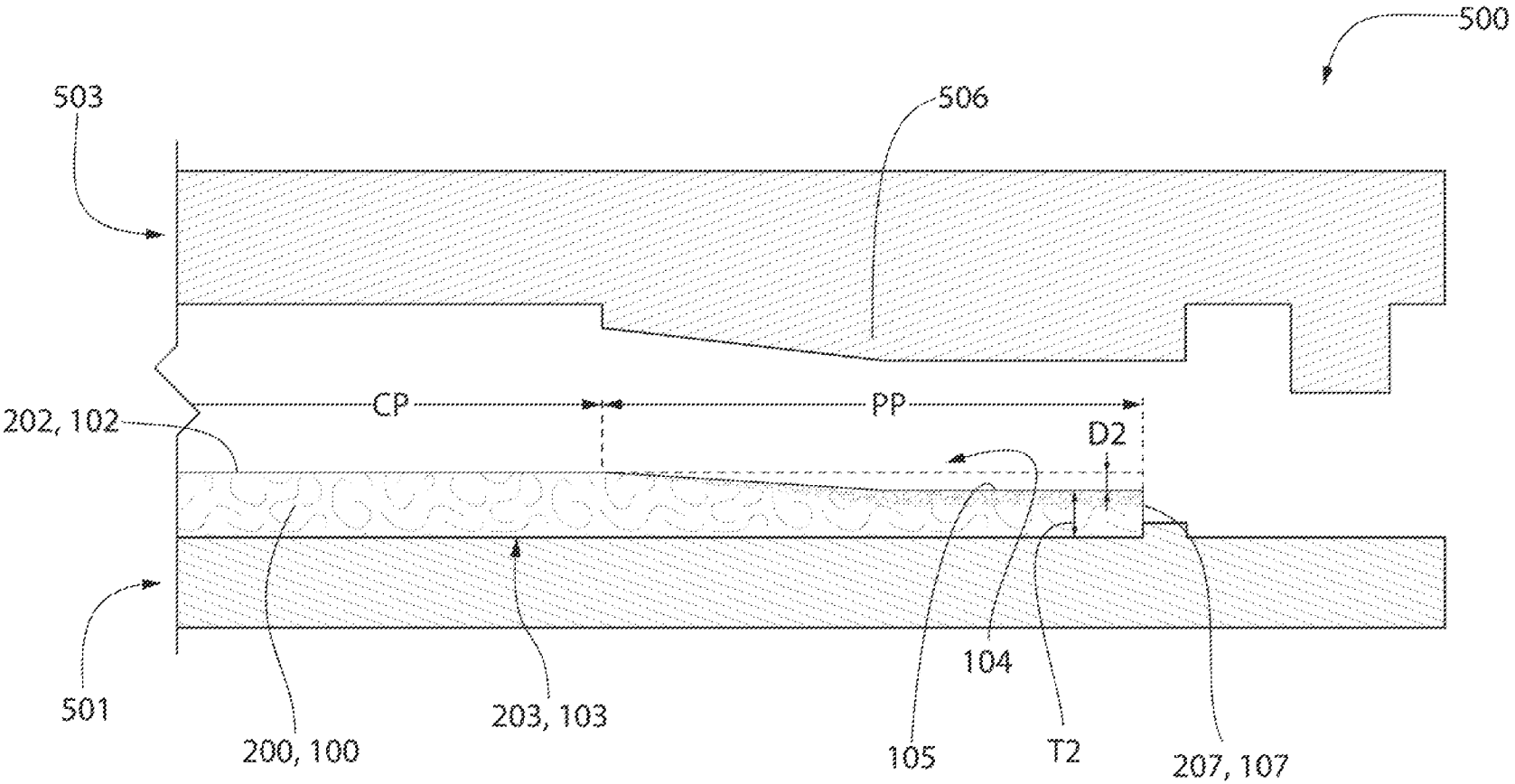
FIG. 6C is a cross-section of the press of FIG. 6B in which the profiling tool of the press has been withdrawn and the perimeter portion of the flat fibrous panel has rebounded to a second compressed state.

Referring now to FIG. 6C, upon expiration of the predetermined period of time, the die 503 is raised, thereby withdrawing the profiling tool 506 from contact with the flat fibrous panel 200 and removing the profiling tool 506 from the transitory recess 550 (FIG. 6B). Upon the pressure exerted by the profiling tool 506 being ceased, the compressed/compacted perimeter portion PP of the flat fibrous panel 200 rebounds to a second compressed amount (shown in FIG. 6C), which is less than the first compressed amount (shown in FIG. 6B). As a result, the thickness of the flat fibrous panel 200 (which is now the acoustical building panel 100) measured from the recess floor surface 105 to the second planar surface 203 (which is also now the second major surface 103) increases to the second thickness T2 (discussed above) from the transitory thickness TT. Stated simply, the transitory recess 250 becomes the permanent recess 104 (described in detail above with respect to FIGS. 1-2A). The permanent recess 104 has a second maximum depth D2 that is less than the first maximum depth D1. Thus, the flat fibrous panel 200 has become the acoustical building panel 100 (which has the structural details and properties discussed above for FIGS. 1-2A or FIGS. 24-24A if a scrim is used).

In one embodiment, a ratio of the second maximum depth D2 to the first maximum depth D1 is 1.5:1 or greater, more preferably 2.5:1 or greater, and most preferably in a range of 1.5:1 to 3.5:1.

In an embodiment where the flat fibrous panel 200 comprises a fibrous board and a scrim coupled thereto during the compression process of FIGS. 6A-C, the scrim may assist with preventing crumbling and/or fracturing of the fibrous board. Additionally, while the press may be in the form of a roller press, it is desirable in certain embodiments that the press be a translation press to prevent delamination of the scrim from the fibrous board and/or significant lateral forces on the fibrous panel.

During the pressing process discussed above for FIGS. 6A-C, the side edge surfaces 207 of the flat fibrous panel 200 are free of any cutouts or channels. Thus, the formation of the permanent recess 105 is achieved solely by compression of fibers of the flat fibrous panel 100 and results in permanent compaction of said fibers.

While the press-forming of the permanent recess 104 into the flat fibrous panel 200 is exemplified as a single step pressing process, in other embodiments, this may be multiple step process. In such a multiple step process, the flat fibrous panel 200 may have to be rotated between pressing operations until all sides of the flat fibrous panel 200 have the permanent recess 104 formed therein, so that the permanent recess 104 circumscribes the central portion CP of the flat fibrous panel 200 thereby forming a profiled fibrous panel (which is the acoustical building panel 100). Preferably, the pressing tool 206 is designed so that it can simultaneously press-form the permanent recess 104 into the top surface 202 of the flat fibrous panel 200 along a portions of a plurality of non-parallel linear side edge surfaces 207 of the flat fibrous panel 200. As mentioned above, the flat fibrous panel 200 may be in a fully-dried state during the pressing process to form the permanent recess 104.

In certain embodiments, the flat fibrous panel 200 may be pre-treated prior to said pressing process. For example, the flat fibrous panel 200 may be subjected to a at least one of a heating process in which the flat fibrous panel 200 is heated to a temperature above ambient or a wetting process in the flat fibrous panel 200 is wetted. Such pre-treatment processes may help with achieving the permanent recess 104 by ensuring permanent compression/compaction of the fibers in the perimeter portion PP.

Subsequent to the pressing process, the acoustical building panel 100 (which may be considered a profiled fibrous panel) may be subjected to a post-treatment. Suitable post-treatment processes include drying the profiled fibrous panel, painting the profiled fibrous panel, heating the profiled fibrous panel, and/or trimming the profiled fibrous panel.

Referring now to FIGS. 7-20, a surface covering system 1000, along with a method of installing the same, according to embodiments of the present invention will now be described. As will be discussed in greater detail below, the surface covering system 1000 generally comprises a plurality of the acoustical building panels 100 (or 100A) described above mounted to a support structure 500 in abutting relationship and within the same plane. A seam concealment sub-system 700 is provided to hide all seams (and fasteners) between the adjacent ones of the acoustical building panels 100 (or 100A) so that the resulting surface covering system has an uninterrupted and monolithic appearance from the room environment. It is to be understood that the surface covering system 1000 can be installed as a ceiling (i.e., the room environment is located below the monolithic surface of the surface covering system 1000) or as one or more walls (i.e., the room environment is located to the side of the monolithic surface of the surface covering system 1000).

Figure 7:
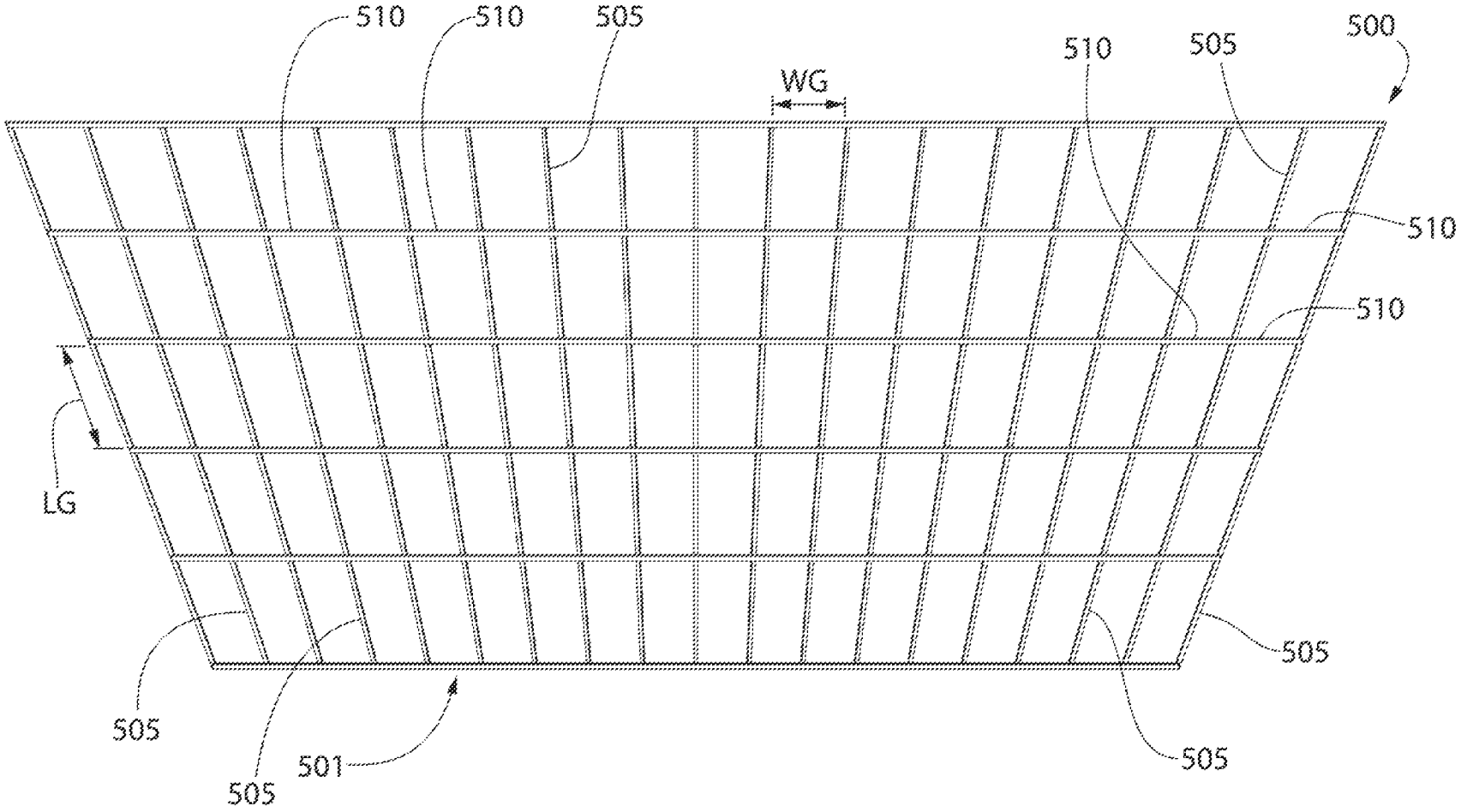
FIG. 7 is a perspective view of a support structure, in the form of a grid, that is used in a method of installing a surface covering system in accordance with an embodiment of the present invention.
Figure 8:
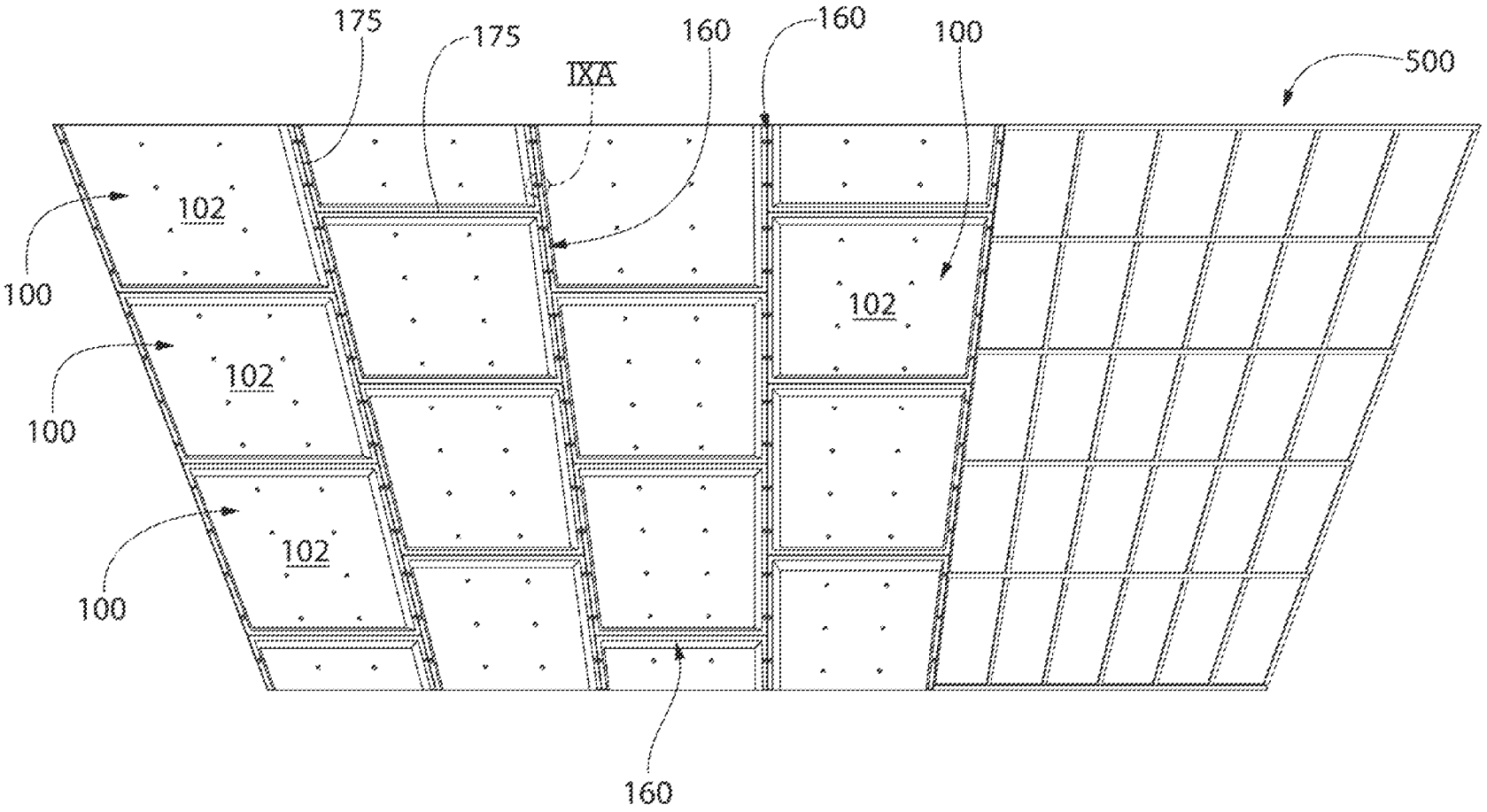
FIG. 8 is a perspective view of a plurality of the acoustical building panels according to FIG. 1 being mounted to the support structure in accordance with an embodiment of the present invention.
Figure 9A:
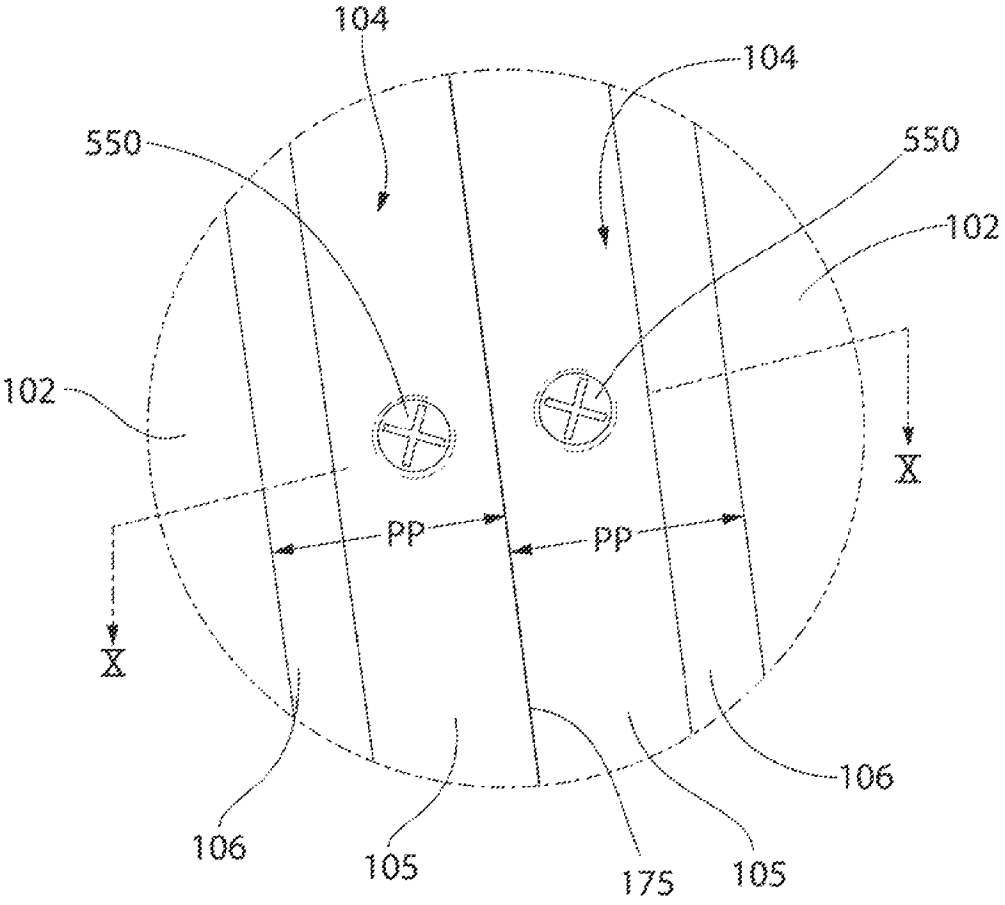
FIG. 9A is a close-up view of area IX1 of FIG. 8.
Figure 10:
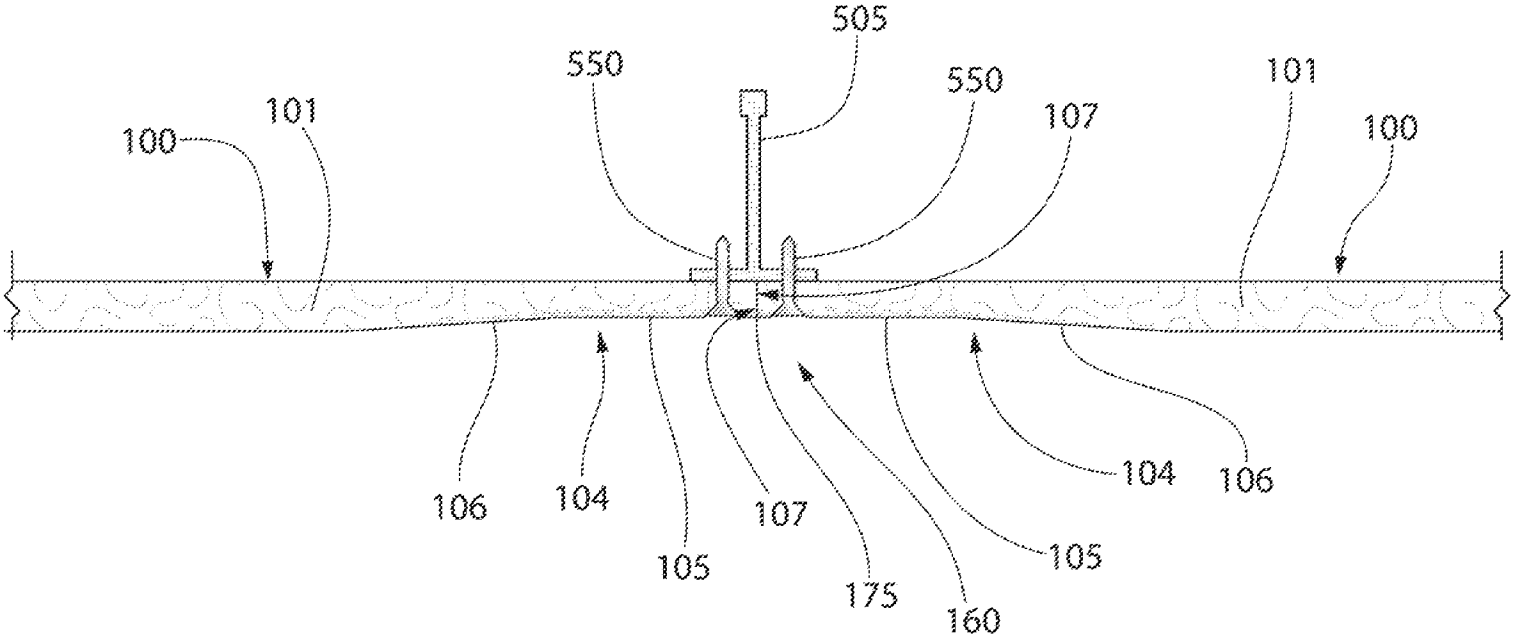
FIG. 10 is a cross-sectional view taken along view X-X of FIG. 9A.
Figure 11:
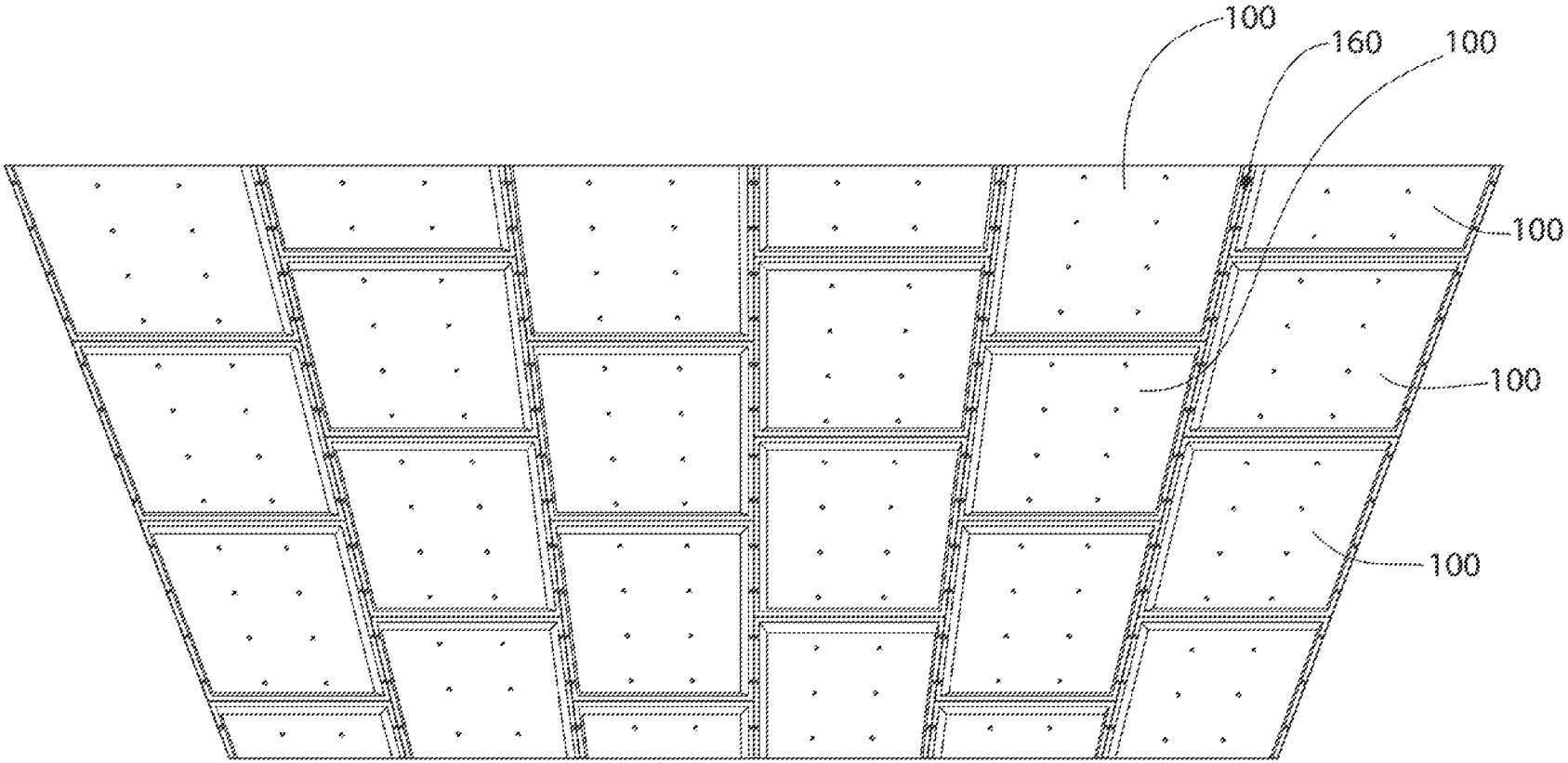
FIG. 11 is a perspective view of the acoustical building panels mounted to and covering the entirety of the support structure.

Referring now to FIG. 7, a support structure 500 is provided. In the exemplified embodiment, the support structure 500 is a rectilinear grid 501 comprising main runners 510 and cross-runners 505. The main runners 510 are separated by a grid length LG while the cross-runners 505 are separated from one another by a grid width WG. The grid length LG is greater than the grid width GW in the exemplified embodiment. In one such embodiment, the main runners 510 are installed at approximately 48 in. on center while the cross runners 505 are installed 16 in. on center. The main runners 510 and cross-runners 505 may be formed of metal and can be rectangular beams, I-beams, L-beams, or T-grid, depending on environment and whether the surface covering system 1000 is to be a ceiling or a wall for a room environment. The support structure 500 may also take on other forms, such as wooden framing beams, masonry surfaces, or simply the surface itself that is intended to be covered.

Referring now to FIGS. 8-11 concurrently, once the support structure 500 is installed (or is in existence), a plurality of the acoustical building panels 100 (described above with respect to FIGS. 1-2A) are mounted to the support structure 500. While the surface covering system 1000 (and installation method) will be described in relation to the acoustical building panels 100, it is to be understood that the acoustical building panels 100A may be used alternatively with all other details remaining the same.

The acoustical building panels 100 are mounted to the support structure 500 so that the side edge surfaces 107 of adjacent ones of the acoustical building panels 100 abut one another. Additionally, when the formation of a monolithic planar surface is desired, the first major surfaces 102 of the acoustical building panels 100 all lie in substantially the same plane.

The acoustical building panels 100 are mounted to the main runners 510 and the cross-runners 505 of the support structure 500 by fasteners 550, such as drywall screws. During the panel mounting step, the acoustical building panels 100 are positioned so that the side edge surfaces 107 of adjacent ones of the plurality of acoustical building panels 100 abut one another and define a seam 175 therebetween. The seam 175 may be a small gap, an interface between abutting side edge surfaces 107, or combinations thereof.

The permanent recesses 104 (which are press-formed into fibrous panels as discussed above) of the adjacent ones of the plurality of acoustical building panels 100 collectively define a seam channel 160. Each of the first major surfaces 102 of the acoustical building panels 100 is circumscribed by one of the seam channels 160 (except for acoustical building panels 100 that are located along the perimeter, which may be cut to size in the field). The fasteners 550 are used along the seam channels 160 to secure the acoustical building panels 100 to the support structure 500. Along the edges of the acoustical building panels 100, the fasteners 550 extend through the perimeter portions PP of the acoustical panels 100 and into the support structure 500. More specifically, the fasteners penetrate the recess floor surfaces 105 of the acoustical building panels 100 and, thus, are located within the recesses 104 (and the seam channels 160).

The acoustical building panels 100 continue to be mounted to the support structure until the entire surface is covered. In the embodiment exemplified, the acoustical building panels 100 are mounted to the support structure in a staggered (brick) pattern. In such a pattern, the acoustical building panels 100 are in a rectilinear pattern of aligned columns and staggered row.

Figure 21:
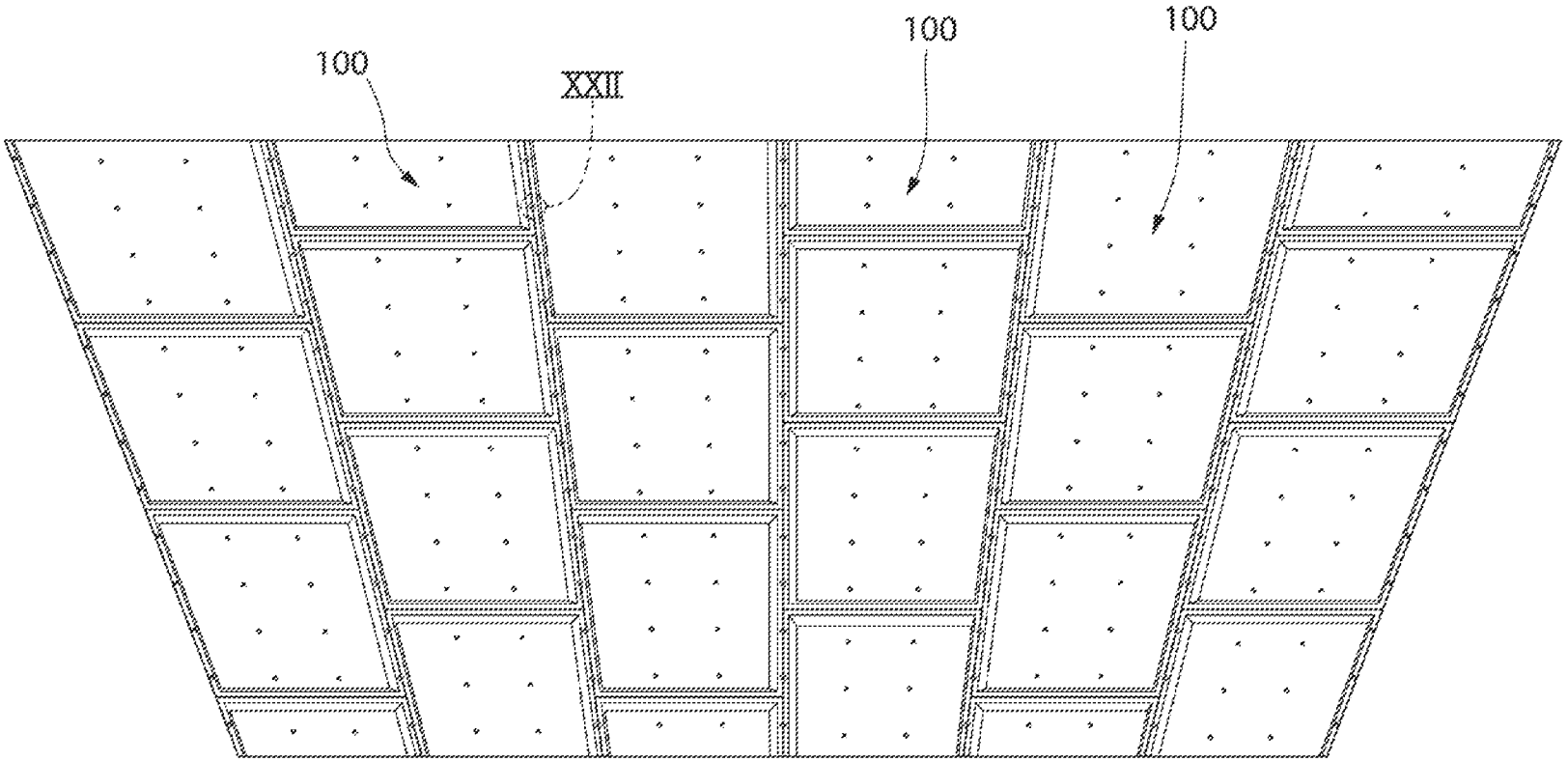
FIG. 21 is a perspective view of the acoustical building panels mounted to and covering the entirety of a support structure according to another embodiment of the present invention, wherein a single fastener and washer are used to engage multiple ones of the acoustical building panels to the support structure.
Figure 22:
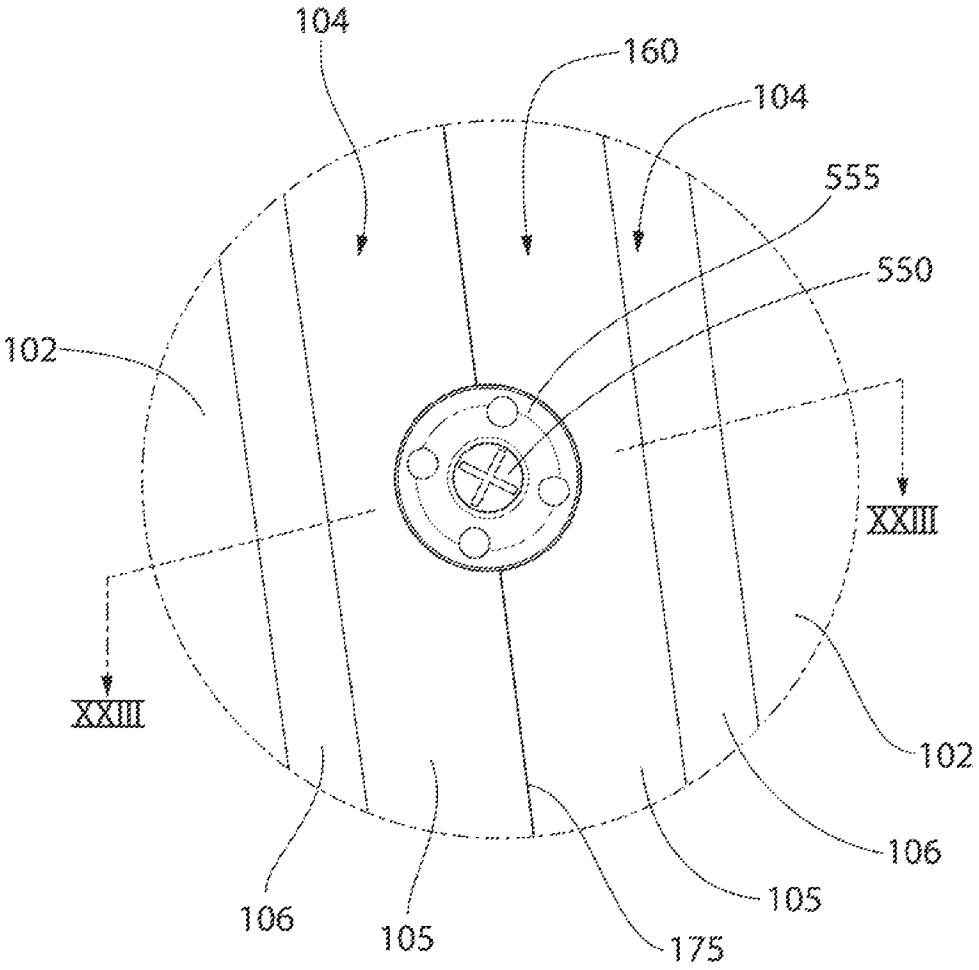
FIG. 22 is a close-up of area XII of FIG. 21.
Figure 23:
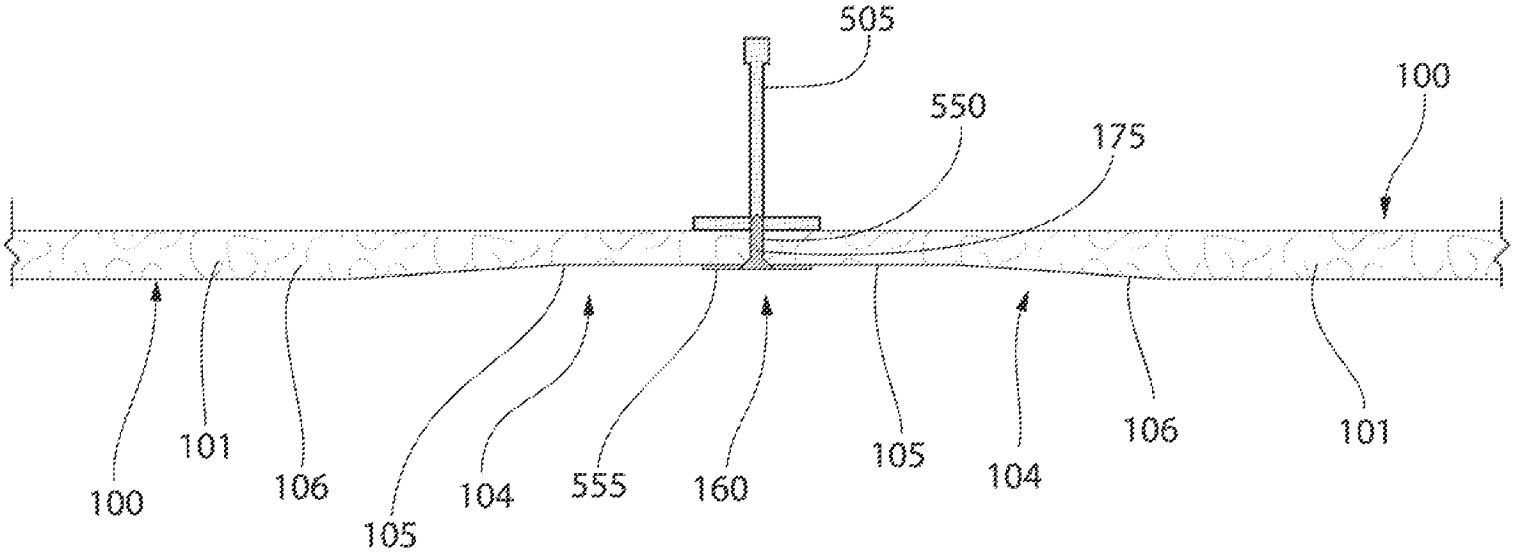
FIG. 23 is a cross-sectional view taken along view XXIII-XXIII of FIG. 22.

Referring now to FIGS. 21-23 concurrently, an alternate way of mounting the acoustical building panels 100 to the support structure 500 is exemplified. In this embodiment, the acoustical building panels 100 are mounted to the runners 505, 510 of the support structure 500 by a fastener 550 and washer 555 assembly. In this embodiment, each of the fasteners 550 extends through one of the washers 555, through one of the seams 160, and into the runner 505, 510. As can be seen, each of the washers 555 bridges the seam 160 at which it is positioned and engages the recess floor surfaces 105 of at least two adjacent ones of the acoustical panels 100. At corner positions, each of the washers 555 may engage three adjacent ones of the acoustical panels 100.

Figure 12:
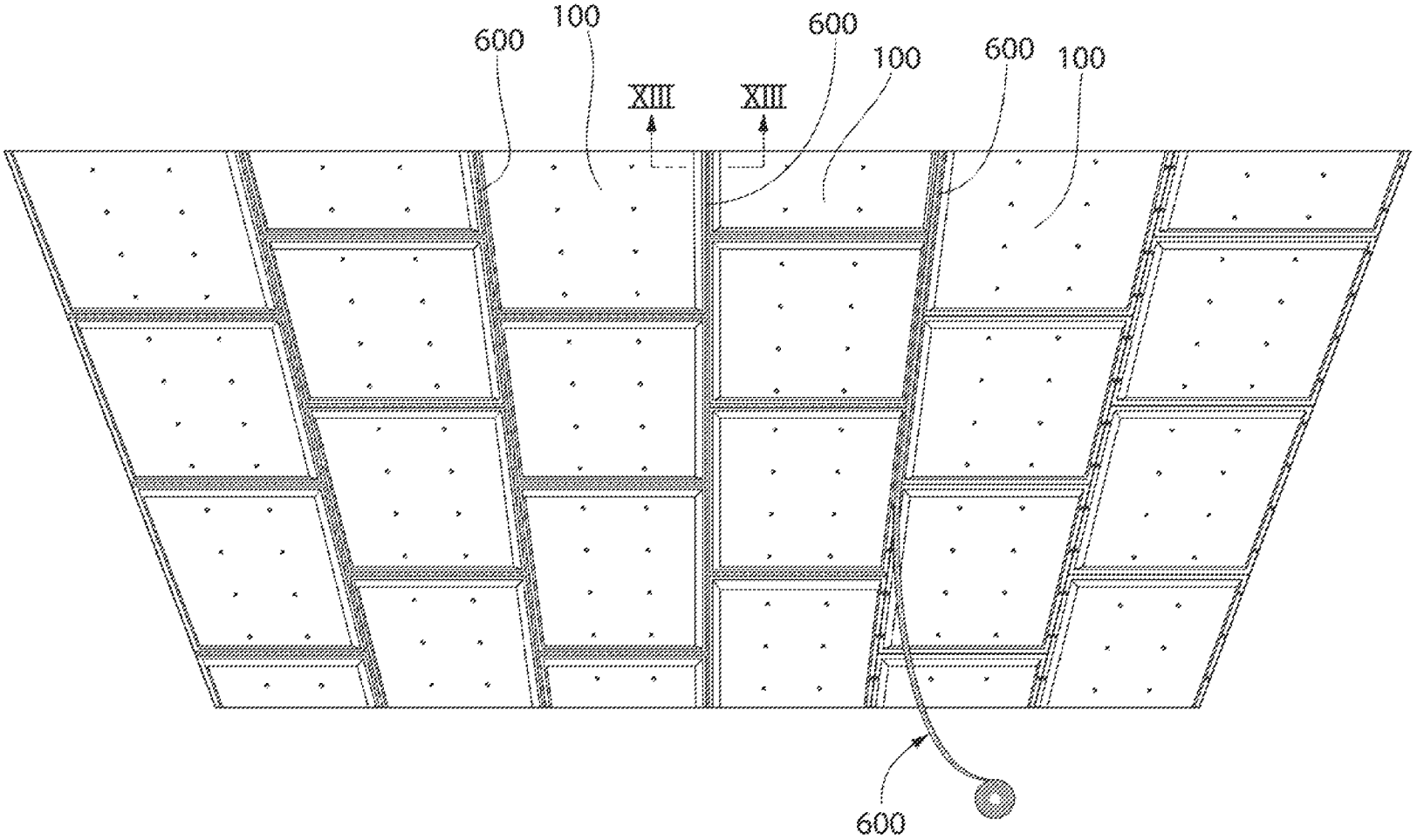
FIG. 12 is a perspective view of the partially installed surface covering system of FIG. 12 wherein tape is being applied to the acoustical building panels to overlie seams between adjacent ones of the acoustical building panels.
Figure 13:
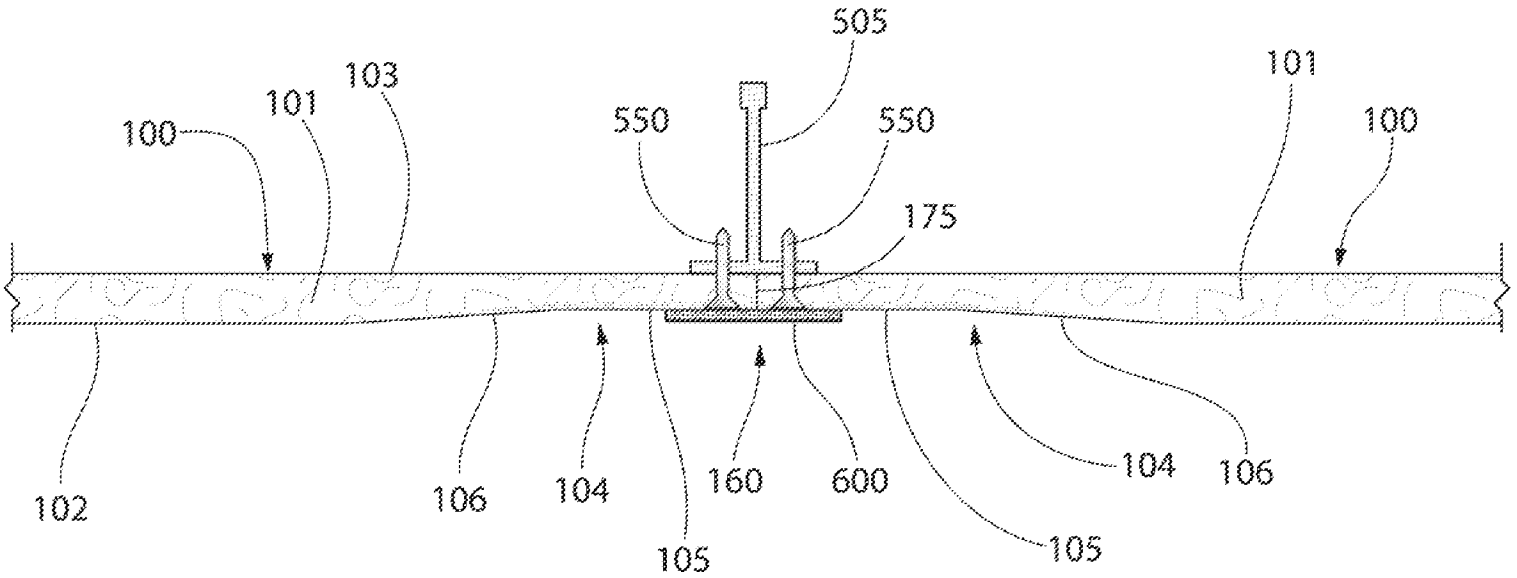
FIG. 13 is a cross-sectional view taken along view XIII-XIII of FIG. 12.
Figure 14:
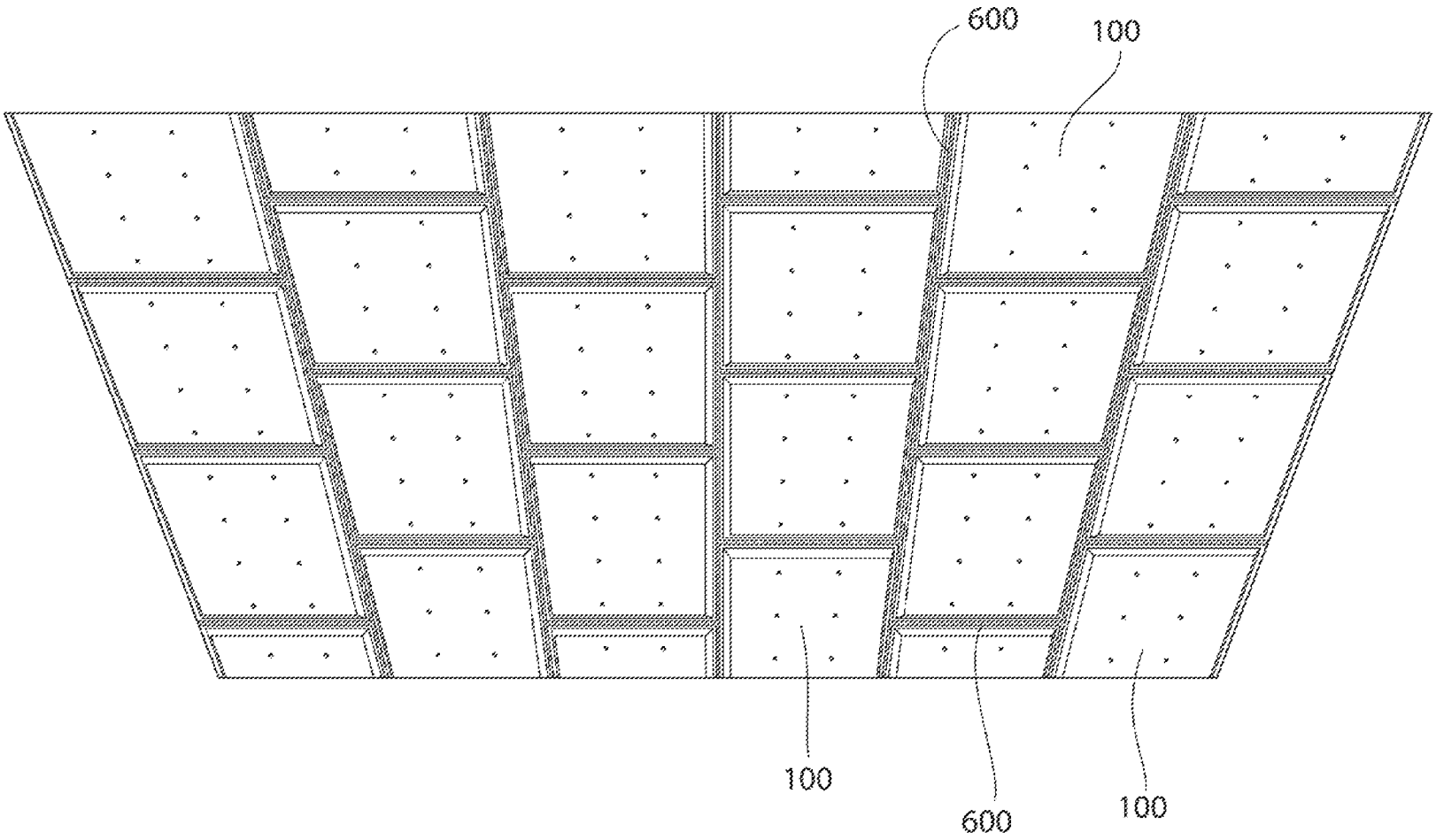
FIG. 14 is a perspective view of the partially installed surface covering system of FIG. 12, wherein the tape has been applied to all seams.

Referring now to FIGS. 12-14 concurrently, once all of the acoustical building panels 100 are mounted to the support structure 500, the process of hiding the seams 175 (and the seam channels 160) using a seam concealment sub-system 700 to create a surface 1001 having a monolithic appearance is undertaken.

For each of the seam channels 160, a tape 600 is adhered directly to the fibrous panels 101 of the acoustical building panels 100. Thus, there is no composition (other than the adhesive of the tape 600), such as joint compound or filler, between the tape 600 and the fibrous panels 101 of the acoustical building panels 100. The tape 600 overlies and spans the seams 175 and is positioned within the seam channels 160. In one embodiment, the tape 600 is directly adhered to recess floor surface 105 of the recesses 104 of adjacent ones of the acoustical building panels 100. Because the recess floor surfaces 105 of the recesses 104 are formed by portions of the fibrous panel 101 that have undergone permanent fiber compaction, the tape 600 is better able to adhere to said surfaces. The tape 600 may be a fiberglass mesh tape. The tape 600 may have a pre-applied adhesive on one surface of the tape 160. The tape 600 has a thickness that is less than the depth of the permanent recesses 104. The tape 600 is provided in roll form but may be provided as strips or sheets.

Figure 15:
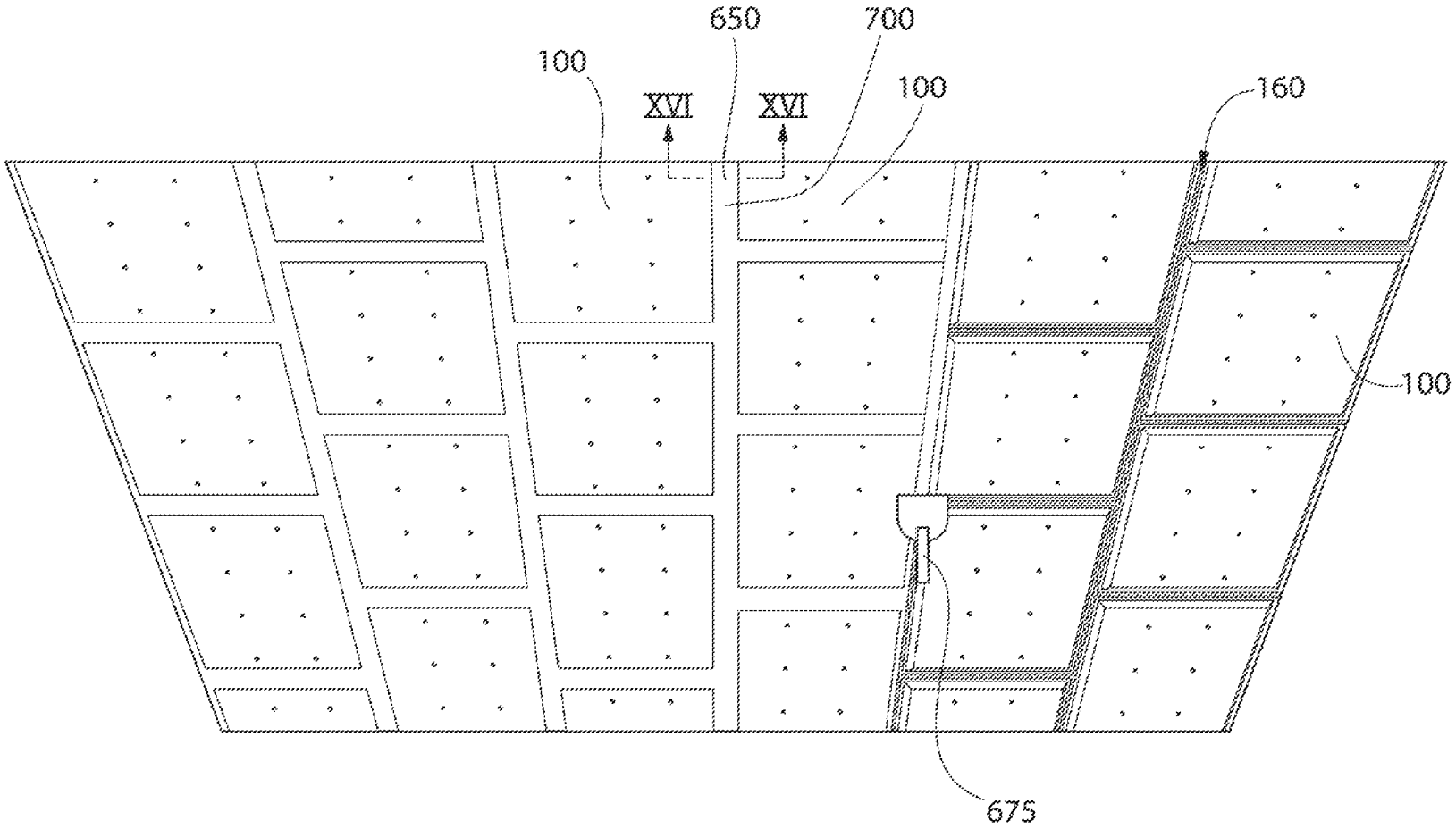
FIG. 15 is a perspective view of the partially installed surface covering system of FIG. 14 wherein joint compound is being applied to cover the tape and fill seam channels.
Figure 16:
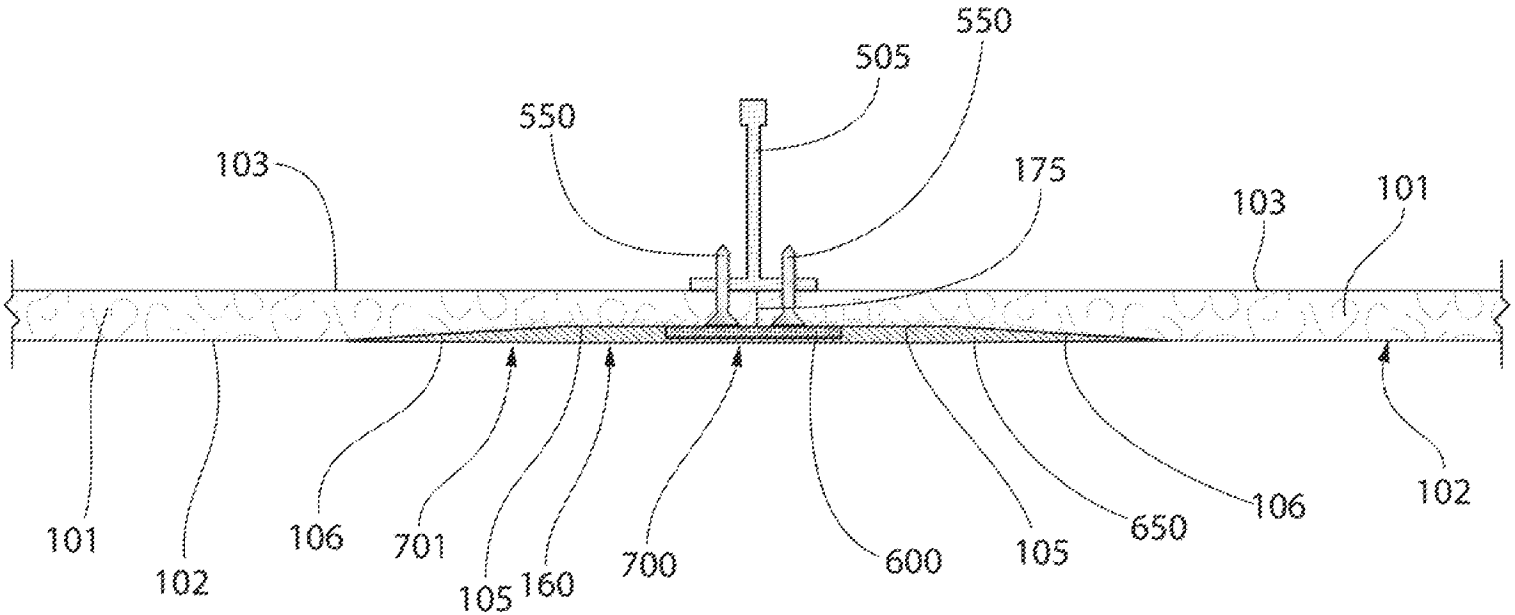
FIG. 16 is a cross-sectional view taken along view XVI-XVI of FIG. 15.
Figure 17:
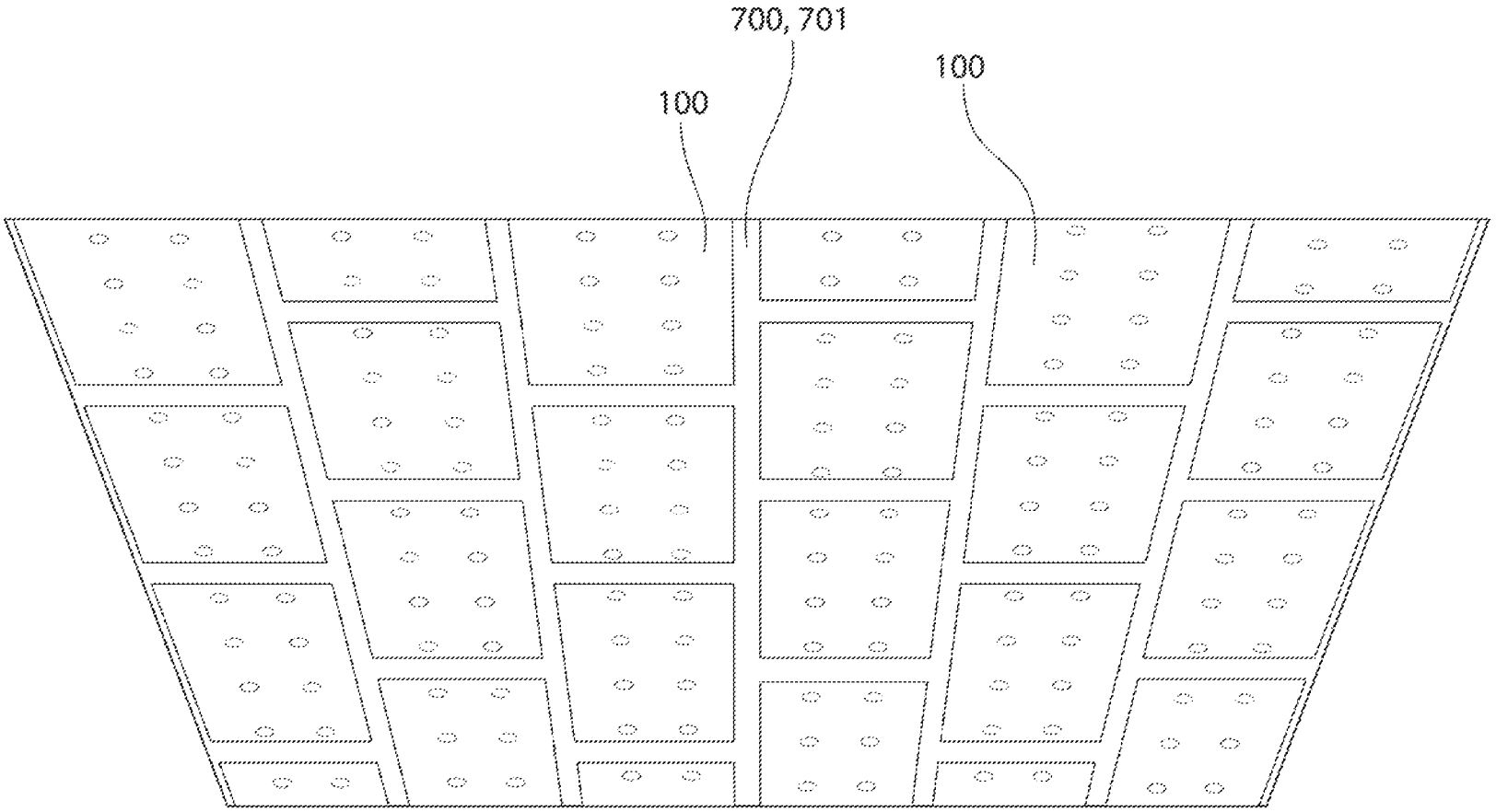
FIG. 17 is a perspective view of the partially installed surface covering system of FIG. 15, wherein the joint compound has been applied to all seam channels.

Referring now to FIGS. 15-17 concurrently, once the tape 600 is applied to the seams 175 within the seam channel 160, the remainder of the seam channel 160 must be filled. Thus, one or more layers of joint compound 650 is applied into the seam channels 160 over the mesh tape 600. The joint compound 650, in conjunction with the tape 600, form a seam concealment subsystem 700. Once dried, the joint compound 650 is then sanded. After sanding, the seam concealment subsystem 700 has an exposed outer surface 701 that is substantially coplanar and flush with the first major surfaces 102 of the acoustical ceiling panels 100.

In one embodiment, the application of the joint compound 650 is a multi-step process utilizing various layers. For example, in a first step, a setting type joint compound (e.g., Proform Quickset 45) is applied over the tape 600 using a 6 inch wide taping knife. After this setting type joint compound is fully dried, a second layer of the setting type joint compound is applied over the areas of the seam channels 160 where the fasteners 550 are located within the seam channels 160. When this second layer is dried, a layer of premixed ultra-lightweight joint compound is applied over the joint compound in the full length of each seam channel 160 using an 8 inch taping knife. When this layer is dried, a finish layer of ultra-lightweight joint compound is applied over the length of each seam channel 160 joint using a 10 inch taping knife. Between layers of joint compound, any sharp ridges in the compound are scraped or lightly sanded before applying the next layer. After the final coat of joint compound is applied and dried, all exposed surface 701 of the seam concealment system are sanded completely.

It should be noted that fasteners 550 used at inboard locations on the acoustical building panels 100 to mount the acoustical building panels 100 to the support structure 500 are hidden in a manner similar to that discussed above for the seams 175, except that the taping step may be omitted. Concealment of inboard fasteners is done in parallel with the seam concealment.

Figure 18:
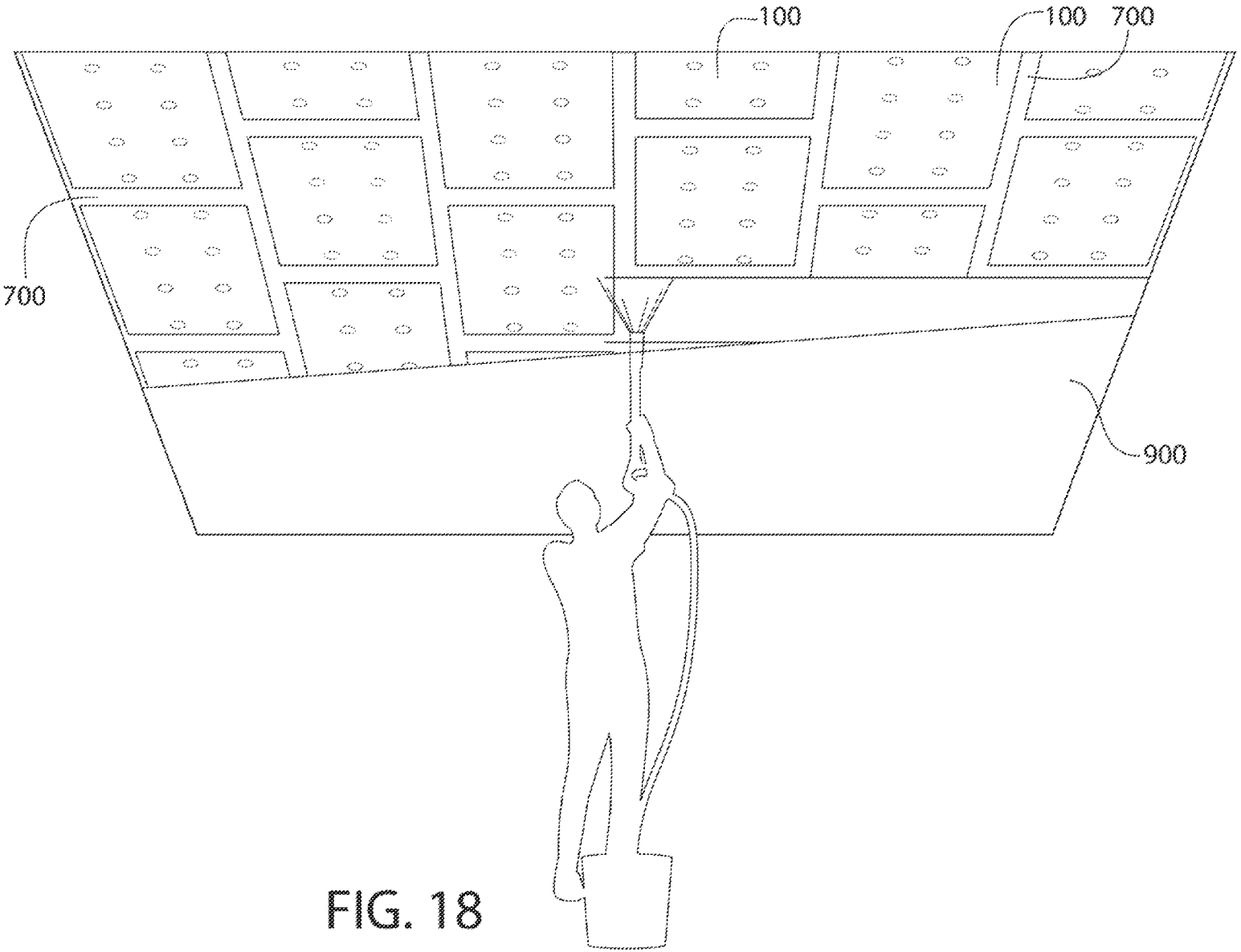
FIG. 18 is a perspective view of the partially installed surface covering system of FIG. 17, wherein a finish coating is being applied.
Figure 19:
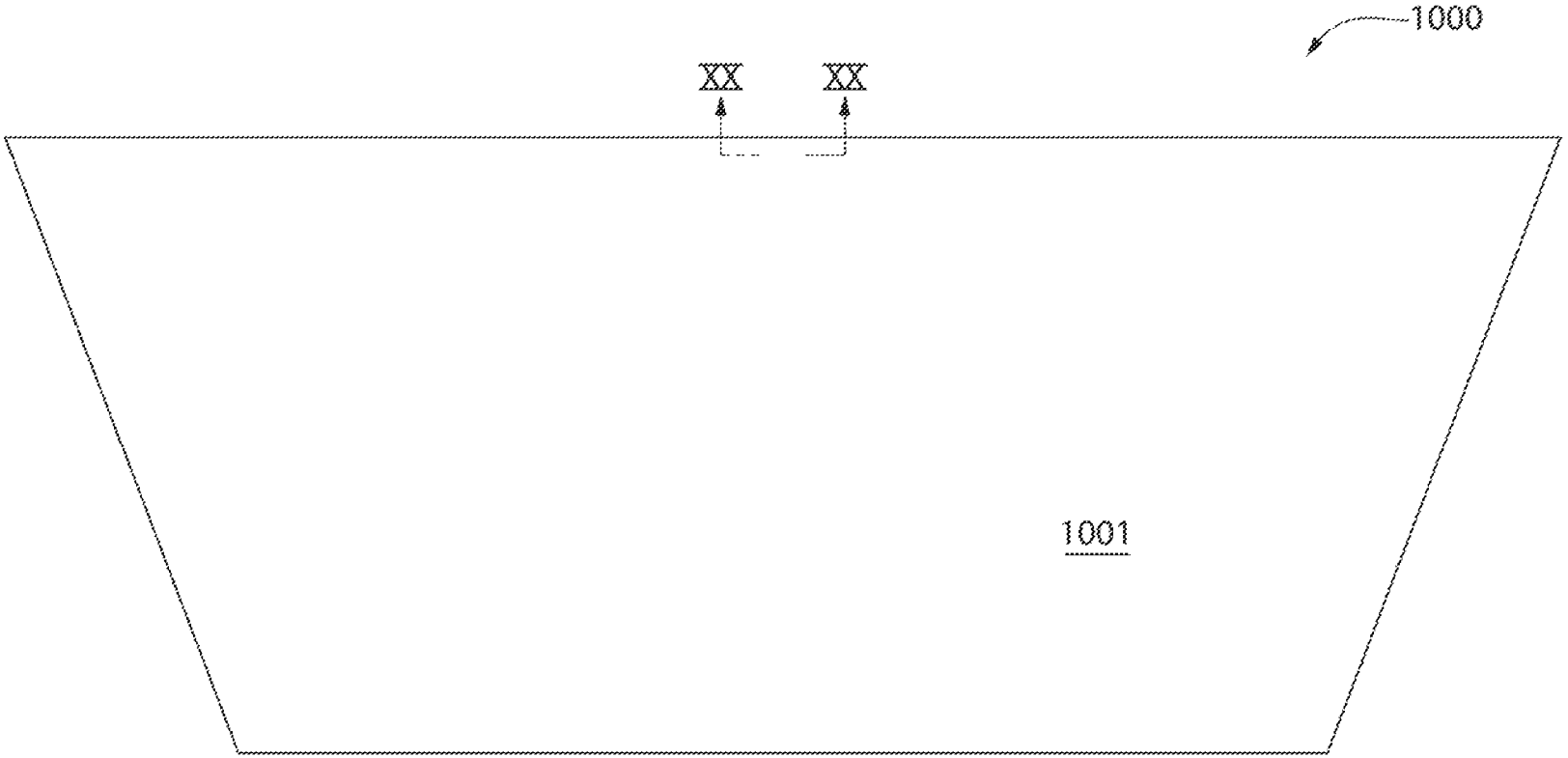
FIG. 19 is a perspective view of a fully installed surface covering system according to an embodiment of the resent invention, wherein the finish coating is fully applied.
Figure 20:
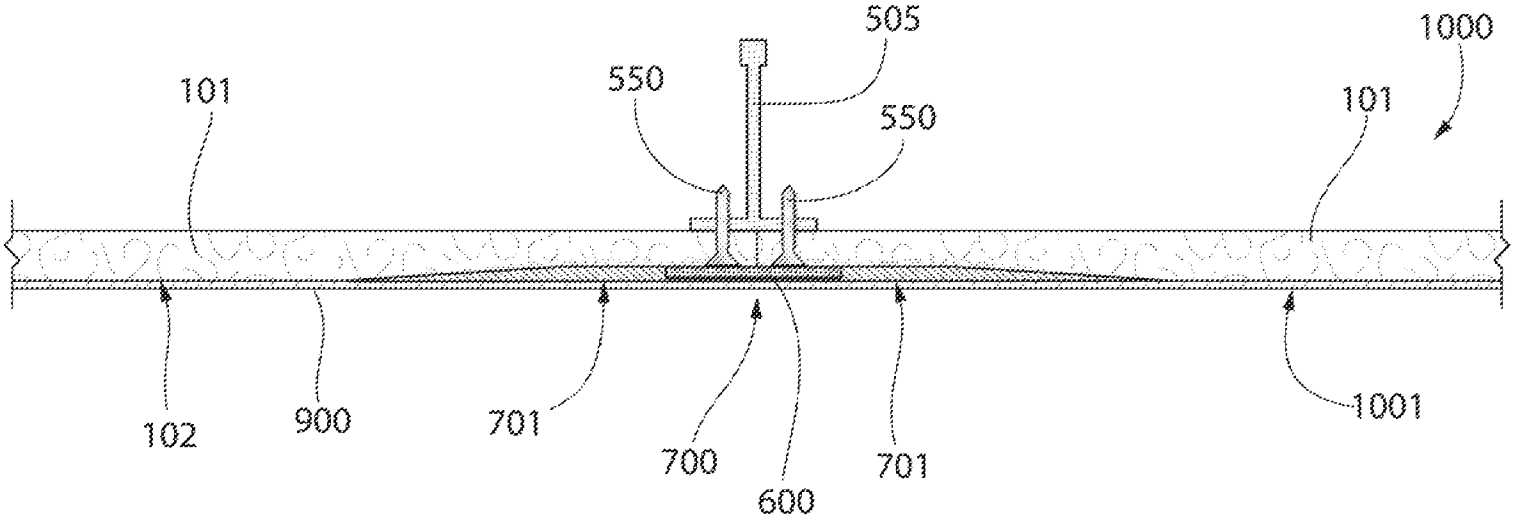
FIG. 20 is a cross-sectional view taken along view XX-XX of FIG. 19.

Referring now to FIGS. 18-20 concurrently, once the seam concealment subsystem 700 is completed, a coating 900 is applied to the first major surfaces 101 of the plurality of acoustical building panels 100 and the exposed surfaces 701 of the seam concealment sub-system 700 to give the exposed surface 1001 of the surface covering system 1000 a monolithic appearance that is free of seams.

The coating 900 may be a high solids paint. The coating 900 may be an acoustically transparent finish paint. One suitable high solids paint is a coating composition comprising: a liquid carrier; a solid blend comprising: a binder having a pH of at least about 7.0 and a Tg of at least 20° C.; a pigment; and a viscosity modifier. The pigment and binder may be present in a weight ratio of at least about 5:1, and wherein the liquid carrier is present in an amount ranging from about 10 wt. % to about 30 wt. % based on the total weight of the coating composition.

In other embodiments, the high solids paint may be a coating composition comprising: a liquid carrier; a solid blend comprising: a binder; a pigment; and a viscosity modifier comprising a humectant and a dispersant present in a weight ratio ranging from about 1:1 to about 4:1. The pigment and binder are present may be present in a weight ratio of at least about 5:1, and wherein the liquid carrier is present in an amount ranging from about 10 wt. % to about 30 wt. % based on the total weight of the coating composition.

The binder may have a glass transition temperature (Tg) of at least 30° C. The binder may be a styrene acrylic copolymer. The binder may be polyvinyl acetate. The viscosity modifier may comprise a humectant and a dispersant. The humectant may be one or more of ester-containing humectants including sugar-based esters and glycol-based esters. The dispersant may comprise an ionic dispersant. The dispersant may comprise a non-ionic dispersant.

The pigment is selected from one or more of titanium dioxide, calcium carbonate, alumina trihydrate, and diatomaceous earth. The pigment and binder in the coating composition may be present in a weight ratio of at least 7:1.

The dry coating 900 may have a total thickness ranging between about 7.5 mils to about 20 mils—including all thicknesses and sub-ranges there-between. The coating in the dry state may exhibits an MKS Rayls value of at most 1,000. The coating 900 may be applied via a sprayer. Specifically, the coating 900 may be applied using an air assist spray system.

The coating 900 may be applied in a multi-coat process. The multi-coat process comprises application of at least two separate coatings of the coating composition. The multi-pass process includes application of a first coating in a wet-state to a thickness ranging from about 2.75 mils to about 3.25 mils—preferably about 3 mils. The first coating may be dried for a period of at least 40 minutes based on standard room environment conditions, including relative humidity. Once dried, the first coating is in a dry-state and have a thickness ranging from about of about 2.0 mils to about 2.5 mils—preferably about 2.25 mils.

According to the present invention, the phrase "dry-state" indicates a composition that is substantially free of a liquid carrier (e.g., liquid water). Conversely, a composition that is in a "wet-state," which refers to a composition containing various amounts of liquid carrier.

Once the first coating is dried, a second coating in the wet-state may be applied to the first coating in the dry-state. The second coating may be applied in the wet-state to a thickness ranging from about 2.75 mils to about 3.25 mils—preferably about 3 mils. The second coating may then be dried for a period of at least 30 minutes based on standard room environment conditions, including relative humidity, resulting in the second coating being in a dry-state. The dry-state second coating may have a thickness of about 2.0 mils to about 2.5 mils—preferably about 2.25 mils. The second coating may be applied directly to the dried first coating, whereby no sanding or pre-treatment of the first coating is performed before application of the second coating.

Once the second coating is dried, a third coating in the wet-state may be applied to the second coating in the dried state. The third coating may be applied in the wet-state to a thickness of about 4.5 mils to about 5.5 mils—preferably about 5 mils. The third coating may be dried for a period of at least 30 minutes based on standard room environment conditions, resulting in the third coating being in a dry-state. The dry-state third coating may have a thickness ranging from about 3.25 mils to about 4.25 mils—preferably about 3.75 mils.

The second coating in the dry-state may be sanded lightly with a 220 grit sandpaper before application of the third coating. The third coating may be spray-applied at a different pressure setting compared to the first and/or second coating. Specifically, the third coating may spray-applied at an atomization pressure that results in a splatter coat, whereas the first and second coating may have been applied with pressure that resulted in a non-splatter coat (for example, a smooth coating surface).

Once the third coating is dried, a fourth coating in the wet-state may be applied to the third coating in the dried state. The fourth coating may be applied in the wet-state to a thickness of about 2.0 mils to about 2.5 mils. The fourth coating may be dried for a period of at least 30 minutes based on standard room environment conditions, resulting in the fourth coating being in a dry-state. The dry-state fourth coating may have a thickness ranging from about 1.5 mils to about 1.85 mils.

The total coating 900 may be applied in an amount resulting in a dry coating weight ranging from about 10 g/ft$^2$ to about 70 g/ft$^2$—including all amounts and sub-ranges there-between. The multi-coat process may also comprise a first coat of the paint/coating 900 is applied as a fine, light coat, with minimal spatter of approximately 10 g/sf to the entire surface. The finely applied first coat is allowed to dry. A second coat of the paint/coating 900 is then applied at the same pressure as the first coat, to product another fine, light coat, with minimal spatter of 10 g/sf. This second coat is applied to the areas without joint compound only the areas of the board between the spackled seam channels and in between other areas where the inboard fasteners are covered). This second coat is allowed to dry. A final coat of the paint/coating 900 is then applied at a slightly lower pressure to produce a "spatter" coat. This spatter coat is approximately 20 g/sf and is applied over the entire surface. This final coat is allowed to dry.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An acoustical building panel comprising:

a fibrous panel comprising:

a central portion having a first major surface;

a perimeter portion surrounding the central portion;

a recess press-formed into the perimeter portion, the recess circumscribing the first major surface and comprising a recess floor surface and a recess wall surface;

a second major surface opposite the first major surface; and side edge surfaces that define a perimeter of the fibrous panel and extend from the second major surface to the recess floor surface;

wherein the recess floor surface is substantially planar;

wherein the recess wall surface is an inclined surface that extends inward and upward from the recess floor surface to the first major surface of the central portion;

wherein an upper layer portion of the perimeter portion of the fibrous panel is in a permanently-compressed state and a lower layer portion of the fibrous panel is in a non-compressed state; and wherein the entirety of the central portion is in a non-compressed state.

2. The acoustical building panel according to claim 1 wherein the perimeter portion comprises the side edge surfaces, the perimeter portion having a first average density and the central portion having a second average density that is less than the first average density.

3. The acoustical building panel according to claim 1 wherein the recess wall surface is a concave surface.

4. The acoustical building panel according to claim 1 wherein the recess wall surface is a planar surface that is inclined relative to the first major surface and the recess floor surface.

5. The acoustical building panel according to claim 1 wherein the recess floor surface, the second major surface, and the first major surface are substantially parallel to one another.

6. The acoustical building panel according to claim 1 wherein the central portion of the fibrous panel has a first airflow resistance measured from the first major surface to the second major surface and the perimeter portion of the fibrous panel has a second air flow resistance measured from the recess floor surface to the second major surface, the second airflow resistance being greater than the first airflow resistance.

7. The acoustical building panel according to claim 1 wherein the fibrous panel comprises a mineral fiber board.

8. The acoustical building panel according to claim 1, wherein the central portion has a first fiber density, and wherein the perimeter portion has a second fiber density that is greater than the first fiber density.

9. An acoustical building panel comprising:

a mineral fiber panel comprising:

a central portion having a first major surface;

a perimeter portion circumscribing the central portion, the perimeter portion having a recess comprising a recess floor surface;

a second major surface opposite the first major surface; and side edge surfaces that define a perimeter of the fibrous panel and extend from the second major surface to the recess floor surface;

wherein the perimeter portion comprises the side edge surfaces, the perimeter portion having a first average density throughout the entirety of the perimeter portion and the central portion having a second average density throughout the entirety of the central portion that is less than the first average density;

wherein the perimeter portion comprises an upper layer portion of the mineral fiber panel and a lower layer portion of the mineral fiber panel, the upper layer portion having a higher density than the lower layer portion.

10. The acoustical building panel according to claim 9 wherein at least a portion of the perimeter portion of the fibrous panel is in a permanently-compressed state.

11. The acoustical building panel according to claim 10 wherein an upper layer portion of the perimeter portion of the fibrous panel is in the permanently-compressed state and a lower layer portion of the fibrous panel is in a non-compressed state, and wherein the entirety of the central portion is in a non-compressed state.

12. The acoustical building panel according to claim 9 wherein the recess floor surface extends inward from the side edge surfaces and the recess further comprises a recess wall surface extending upward from the recess floor surface to the first major surface.

13. The acoustical building panel according to claim 12 wherein the recess wall surface is a concave surface.

14. The acoustical building panel according to claim 12 wherein the recess wall surface is a planar surface that is inclined relative to the first major surface and the recess floor surface.

15. The acoustical building panel according to claim 9 wherein the central portion of the fibrous panel has a first airflow resistance measured from the first major surface to the second major surface and the perimeter portion of the fibrous panel has a second air flow resistance measured from the recess floor surface to the second major surface, the second airflow resistance being greater than the first airflow resistance.

16. The acoustical building panel according to claim 9, wherein the mineral fiber board comprises mineral wool.

17. An acoustical building panel comprising:

a body; and a scrim attached to the body;

the acoustical building panel further comprising:

a central portion having a first major surface;

a perimeter portion circumscribing the central portion, the perimeter portion having an upper layer portion having a first density and a lower layer portion having a second density that is lower than the first density;

a recess having a recess floor surface and a recess wall surface, the recess press-formed into at least a portion of the scrim present in the perimeter portion;

a second major surface opposite the first major surface; and side edge surfaces that define a perimeter of the acoustical building panel and extend from the second major surface to the recess floor surface;

wherein the recess floor surface is substantially planar;

wherein the recess wall surface is an inclined surface that extends inward and upward from the recess floor surface to the first major surface of the central portion;

wherein the scrim is attached to the first major surface of the central portion and the perimeter portion of the body; and wherein the scrim is in a non-compressed state over the central portion of the body and wherein at least a portion of the scrim over the perimeter portion is in a permanently-compressed state.

18. The acoustical building panel according to claim 17, wherein the recess is press-formed into a portion of the body present in the perimeter portion.

19. The acoustical building panel according to claim 17, wherein the portion of the scrim present in the perimeter portion is in a permanently-compressed state.

20. The acoustical building panel according to claim 17, wherein the entirety of the central portion is in a non-compressed state.

* * * * *